US008628161B2

(12) United States Patent
Houjou

(10) Patent No.: US 8,628,161 B2
(45) Date of Patent: Jan. 14, 2014

(54) IMAGE FORMING APPARATUS, IMAGE FORMING METHOD, RECORDING MEDIUM CONVEYANCE APPARATUS AND RECORDING MEDIUM CONVEYANCE METHOD

(75) Inventor: Hiroaki Houjou, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 239 days.

(21) Appl. No.: 13/034,169

(22) Filed: Feb. 24, 2011

(65) Prior Publication Data

US 2011/0205282 A1 Aug. 25, 2011

(30) Foreign Application Priority Data

Feb. 25, 2010 (JP) ..... 2010-040636
Feb. 25, 2010 (JP) ..... 2010-040637

(51) Int. Cl.
*B41J 29/38* (2006.01)
*B41J 2/01* (2006.01)

(52) U.S. Cl.
USPC ..... 347/16; 347/102

(58) Field of Classification Search
USPC ..... 347/5–19, 101–104
IPC ..... B41J 2/01,29/38
See application file for complete search history.

(56) References Cited

U.S. PATENT DOCUMENTS 5,020,244 A * 6/1991 Smith ..... 34/633
2004/0046316 A1* 3/2004 Tsuzawa ..... 271/264
2005/0212852 A1* 9/2005 Konno ..... 347/40
2009/0085997 A1* 4/2009 Sakamoto ..... 347/102
2009/0160897 A1* 6/2009 Inoue ..... 347/14
2009/0231377 A1* 9/2009 Kachi ..... 347/16
2009/0231407 A1* 9/2009 Kachi ..... 347/104
2009/0244237 A1* 10/2009 Kachi ..... 347/102
2009/0311426 A1* 12/2009 Nakazawa et al. ..... 427/256
2009/0322824 A1* 12/2009 Hori ..... 347/30

FOREIGN PATENT DOCUMENTS

JP 10-193772 A 7/1998
JP 2003-211652 A 7/2003
JP 2004-90490 A 3/2004
JP 2004-338175 A 12/2004
JP 2008-179012 A 8/2008
JP 2008-213181 A 9/2008

* cited by examiner

*Primary Examiner* — Manish S Shah
*Assistant Examiner* — Roger W Pisha, II
(74) *Attorney, Agent, or Firm* — Birch, Stewart, Kolasch & Birch, LLP

(57) ABSTRACT

An image forming apparatus includes: a treatment liquid deposition device which deposits a treatment liquid onto a recording medium; an ink ejection device which ejects droplets of ink onto the recording medium; a conveyance device including: a conveyance body having curvature by which the recording medium is carried and conveyed, a holding device which holds a leading end of the recording medium, suction holes for suctioning the recording medium with negative pressure, and a suctioning device which performs suctioning via the suction holes; a heating device which heats the conveyance body and the recording medium from an opposite side of the recording medium to the conveyance body; and a non-contact-type recording medium restricting device which is provided on an upstream side of the heating device so as to press in a non-contact fashion a trailing end of the recording medium from the opposite side to the conveyance body.

10 Claims, 9 Drawing Sheets

IMAGE FORMING APPARATUS, IMAGE FORMING METHOD, RECORDING MEDIUM CONVEYANCE APPARATUS AND RECORDING MEDIUM CONVEYANCE METHOD

BACKGROUND OF THE INVENTION

1. Field of the Invention

The present invention relates to an image forming apparatus and an image forming method, and more particularly, to an image forming apparatus and an image forming method whereby a recording medium can be conveyed stably without affecting an image formed during conveyance on a curved surface.

Furthermore, the present invention also relates to a recording medium conveyance apparatus and a recording medium conveyance method, and more particularly, to a recording medium conveyance method and a recording medium conveyance apparatus whereby a recording medium can be conveyed stably by conveyance on a curved surface.

2. Description of the Related Art

In a system which conveys a recording medium on a conveyance body having curvature, such as a pressure drum, if an image is formed by an inkjet method, then it is necessary to convey the recording medium in a state of tight adherence to the surface of the conveyance body, without any floating up or wrinkling of the recording medium, in order that the recording medium does not contact the inkjet head.

In order to hold the recording medium tightly on the surface of a conveyance body, for example, Japanese Patent Application Publication No. 2008-179012 discloses an apparatus including a device which performs drying while conveying the recording medium suctioned on a rotating drum, in order to dry the ink on the recording medium after printing, reliably in a short time. However, if conveyance by suction is performed using a conveyance body having curvature, such as a rotating drum, then there are possibilities that density non-uniformities could be caused by ink liquid collecting at the suction holes when using thin paper, or the recording medium could not be suctioned onto the surface of the conveyance body due to floating up of the trailing end of the paper as a result of the high rigidity of the paper, when using thick paper.

Furthermore, if conveyance by suction is performed on a conveyance body having curvature such as a rotating drum, then there are possibilities that the recording medium cannot be suctioned in a state of uniform adherence to the surface of the conveyance body, due to slackness and cockling caused by permeation of the ink moisture content in the case of thin paper, and due to floating up of the trailing end of as a result of the high rigidity of the paper in the case of thick paper.

Furthermore, Japanese Patent Application Publication No. 2004-90490 describes a restricting device based on a roller, as an auxiliary device for a suctioning device. However, since the recording medium is restricted by making contact with a roller, then it has not been possible to apply such a device to a recording medium immediately after recording on which an image has been formed and has not yet dried. This is because the image could be transferred to the roller if the device is applied to such a recording medium immediately after recording.

Furthermore Japanese Patent Application Publication No. 2004-90490 describes an image recording apparatus including a suction position changing device which changes the suction position of a suctioning device in accordance with the movement of a roller. However, according to the apparatus disclosed in Japanese Patent Application Publication No. 2004-90490, processing is carried out on each individual wrinkle that occurs in the suctioned state, and if there is a plurality of wrinkles, then there is a possibility that the productivity declines dramatically. Furthermore, Japanese Patent Application Publication No. 2004-90490 does not provide a fundamental solution to the problem of suctioning the medium in a state of uniform adhesion to the surface of the conveyance body.

Japanese Patent Application Publication No. 2004-338175 discloses technology for altering the suction air flow volume in accordance with the type (rigidity, thickness) of recording medium, and describes an inkjet recording apparatus which suppresses decline in the temperature of the recording medium, by altering the suction air flow volume in accordance with the type (rigidity, thickness) of the recording medium.

Japanese Patent Application Publication No. 2003-211652 and Japanese Patent Application Publication No. 10-193772 describe a printing apparatus and a printing method in which a non-contact type of paper restricting device for pressing the recording medium against the surface of the medium is provided, and a printing apparatus and a printing method in which a recording medium is pressed against a conveyance device by an air blowing device.

Even if the suction air flow volume is simply controlled or an air blowing device is simply provided, however, it is difficult to tightly hold and convey the whole of a sheet of thick paper on the surface of a conveyance body having curvature. Furthermore, it is possible to apply the required suction pressure to a recording medium which is thick paper and convey the medium by suction in a state where the thick paper is forcibly caused to adhere tightly to the pressure drum by increasing the pressure of the blown air flow, but if air of a high flow pressure, such as compressed air, is directed onto an image immediately after recording, then the image which is in a liquid state is caused to flow on the recording medium, and hence there is a possibility that image quality is impaired.

Moreover, even if the suction air flow volume is simply controlled or an air blowing device is simply provided, then it is difficult to correct cases where a thin paper is suctioned in a slack state, and if the air blowing timing and suction timing are not appropriate, then there is a concern that the paper will be suctioned in a disorderly fashion.

SUMMARY OF THE INVENTION

The present invention has been contrived in view of these circumstances, an object thereof being to provide an image forming apparatus and an image forming method whereby a recording medium can be conveyed stably, without damaging an image formed thereon.

It is a further object of the present invention to provide a recording medium conveyance apparatus and a recording medium conveyance method whereby a recording medium can be conveyed stably during conveyance on a curved surface.

In order to attain an object described above, one aspect of the present invention is directed to an image forming apparatus comprising: a treatment liquid deposition device which deposits onto a recording medium a treatment liquid including an aggregating agent having a function of increasing a viscosity of ink; an ink ejection device which ejects droplets of the ink onto the recording medium; a conveyance device including: a conveyance body having curvature by which the recording medium is carried and conveyed, a holding device which holds a conveyance direction leading end of the recording medium, a plurality of suction holes for suctioning the recording medium with negative pressure, and a suctioning device which performs suctioning via the suction holes; a heating device which heats the conveyance body and the recording medium from an opposite side of the recording medium to the conveyance body; and a non-contact-type recording medium restricting device which is provided on an upstream side of the heating device in terms of a direction of conveyance of the recording medium so as to press in a non-contact fashion a trailing end of the recording medium from the opposite side to the conveyance body.

According to this aspect, by firstly depositing a treatment liquid containing an aggregating agent on a recording medium, it is possible to increase the viscosity of the ink, and therefore the wear resistance of the image can be improved. Furthermore, since a non-contact-type recording medium restricting device which presses the trailing end of the recording medium is provided, then it is possible to press the trailing end of a recording medium having high durability, onto a conveyance body having curvature, and therefore the recording medium can be made to adhere tightly to the conveyance body without floating up. Consequently, in a recording medium having high rigidity, image damage caused by the non-contact-type recording medium restricting device is reduced by increasing the viscosity of the ink by means of the aggregating agent, and it is possible to cause the recording medium to adhere tightly to the conveyance body by restricting the trailing end. Furthermore, since the viscosity of the ink can be raised by the aggregating agent, then it is possible to suppress the occurrence of non-uniformities in the image density in the regions of the suction holes.

Desirably, the image forming apparatus further comprises a controller which controls a pressing force produced by the non-contact-type recording medium restricting device in accordance with a type of the recording medium.

According to this aspect, since the pressing force of the non-contact-type recording medium restricting device is adjusted in accordance with the type of the recording medium, then it is possible to restrict unnecessary pressing force in the case of a recording medium having lower rigidity, thereby preventing deterioration of the image.

Desirably, the controller controls the pressing force in such a manner that the pressing force produced by the non-contact-type recording medium restricting device progressively increases toward a conveyance direction trailing end of the recording medium.

According to this aspect, since the pressing force of the non-contact-type recording medium restricting device is raised progressively toward the trailing end of the recording medium in the conveyance direction, then it is possible to reduce the pressing force on the leading end of the recording medium in the conveyance direction, and the time during which the image is pressed with a high pressure can be shortened. Therefore, it is possible to reduce deterioration of the image.

Desirably, the controller controls the pressing force in such a manner that the recording medium is pressed by the non-contact-type recording medium restricting device only during passage of a conveyance direction trailing end of the recording medium.

According to this aspect, since only the trailing end of the recording medium in the conveyance direction is pressed by the non-contact-type recording medium restricting device, then it is possible to restrict the trailing end only, without causing damage to the image, and the medium can be conveyed in a stable fashion.

Desirably, a region on which the droplets of the ink are not ejected is provided in a conveyance direction trailing end of the recording medium.

According to this aspect, since a region where droplets of ink are not ejected is provided in the trailing end of the recording medium in the conveyance direction, then no damage is caused to the image by pressing this region, and the recording medium can be caused to adhere tightly to the conveyance body.

Desirably, the non-contact-type recording medium restricting device is an air blowing device.

According to this aspect, since the non-contact-type recording medium restricting device is an air blowing device, then it is possible to restrict the recording medium easily.

Desirably, the aggregating agent is an organic acid.

According to this aspect, by adopting the aggregating agent of an organic acid, it is possible to enhance the viscosity raising action during aggregation and therefore, the fixing force of the ink onto the recording medium can be increased. Consequently, it is possible to suppress damage to the image caused by pressing and density non-uniformities caused by the suction holes.

In order to attain an object described above, another aspect of the present invention is directed to an image forming method comprising: a treatment liquid deposition step of depositing onto a recording medium a treatment liquid including an aggregating agent having a function of increasing a viscosity of ink; an ink ejection step of ejecting droplets of the ink onto the recording medium; a conveyance step of conveying the recording medium which is carried on a conveyance body having curvature and of which a conveyance direction leading end is held while suctioning the recording medium from the conveyance body via the plurality of suction holes; a non-contact-type recording medium restricting step of pressing in a non-contact fashion the recording medium from an opposite side of the recording medium to the conveyance body; and a heating step of heating the conveyance body and the recording medium from the opposite side of the recording medium to the conveyance body.

Desirably, the image forming method further comprises a control step of controlling a pressing force produced in the non-contact-type recording medium restricting step in accordance with a type of the recording medium.

Desirably, in the control step, the pressing force produced in the non-contact-type recording medium restricting step is controlled in such a manner that the pressing force increases progressively toward a conveyance direction trailing end of the recording medium.

Desirably, in the control step, the pressing force produced in the non-contact-type recording medium restricting step is controlled in such a manner that the recording medium is pressed in the non-contact-type recording medium restricting step only during passage of a conveyance direction trailing end of the recording medium.

Desirably, the non-contact-type recording medium restricting step is an air blowing step of blowing an air flow onto the recording medium.

In order to attain an object described above, another aspect of the present invention is directed to a recording medium conveyance apparatus comprising: a conveyance device including: a conveyance body having curvature by which a recording medium is carried and conveyed, a holding device which holds a conveyance direction leading end of the recording medium, a plurality of suction holes for suctioning the recording medium with negative pressure, and a suctioning device which performs suctioning via the plurality of suction holes; a non-contact-type recording medium restricting device which presses in a non-contact fashion the recording medium from an opposite side of the recording medium to the conveyance body; and a controller which controls a pressing position by the non-contact-type recording medium restricting device and a suctioning position by the suctioning device in accordance with a type of the recording medium.

According to this aspect, by providing a non-contact-type recording medium restricting device which presses the recording medium in a non-contact fashion, in combination with a suctioning device provided in the conveyance body, and by controlling the suctioning position in relation to the pressing position on the basis of the type of paper, then even on a conveyance body having a curved surface, it is still possible to stabilize the suctioned state of the recording medium and the recording medium can be conveyed while suppressing the occurrence of slackness and wrinkles.

Desirably, the controller sets the suction position further to a downstream side with respect to the pressing position in terms of a direction of conveyance as the recording medium exhibits lower rigidity.

According to this aspect, by setting the suctioning position further toward the downstream side with respect to the pressing position in terms of the conveyance direction, as the recording medium exhibits lower rigidity, it is possible to perform suctioning in a state where slackness or floating up of the recording medium has been corrected by the air blowing device, and suctioning can be performed uniformly. If suctioning is started at a position near to the pressing position, then the attitude of the recording medium will not have been corrected and the recording medium may be suctioned in a disorderly and slack state, and hence the medium may be suctioned in a partially floating state.

Conversely, if the recording medium has high rigidity, then it is desirable that the suctioning position should be the same as or to the upstream side with respect to the pressing position in terms of the conveyance direction. In this way, it is possible to perform stable suctioning, without floating up of the recording medium, by applying the minimum pressing force and suctioning force necessary to restrict the trailing end of the recording medium. If the suctioning position is to the downstream side with respect to the pressing position in terms of the conveyance direction, then the recording medium which has been made to adhere tightly to the conveyance body due to the non-contact-type recording medium restricting device separates again from the conveyance body and even if suctioning is performed, the recording medium may not be suctioned completely to the conveyance body. Therefore, the number of suction holes that are not closed off increases, the suction pressure declines, and it may become impossible to restrict the recording medium on the conveyance body, and ultimately, after passing the pressing position, the trailing end of the recording medium may bounce back up again.

Desirably, the non-contact-type recording medium restricting device is an air blowing device which supplies an air flow and is disposed in such a manner that an air flow direction is from a downstream side toward an upstream side in terms of a direction of conveyance of the recording medium.

According to this aspect, by supplying an air flow by an air blowing device from the downstream side toward the upstream side of the conveyance direction of the recording medium, it is possible to supply an air flow which causes the recording medium to follow the surface of the conveyance body, and therefore the effect in pressing the recording medium by means of the air flow is further enhanced.

Desirably, the suctioning device performs the suctioning in a stepwise fashion from the conveyance direction leading end of the recording medium.

According to this aspect, by suctioning the recording medium in a stepwise fashion from the leading end in the conveyance direction, it is possible to prevent the recording medium from being suctioned at a position to the upstream side with respect to the pressing position. Furthermore, since the time from the pressing position to the suctioning position can be made almost equal, then even in the case of a recording medium of large size, the occurrence of wrinkles can be suppressed and suctioning can be performed more reliably.

Desirably, the suctioning device is divided into a plurality of sections in a direction of conveyance of the recording medium, suctioning force in each of the plurality of sections being controllable.

According to this aspect, the suctioning device is divided into a plurality of sections in the conveyance direction of the recording medium and it is possible to control the suctioning force in each of the sections respectively, then the occurrence of wrinkles can be suppressed more effectively.

Desirably, the conveyance body is a pressure drum provided in conjunction with a transfer drum.

According to this aspect, a pressure drum is used as a conveyance body and a recording medium is conveyed from a transfer drum, and it is possible to perform conveyance with a high degree of accuracy.

Desirably, the non-contact-type recording medium restricting device is provided inside the transfer drum.

According to this aspect, since a non-contact-type recording medium restricting device is provided inside the transfer drum, then it is possible to reduce the space occupied by the non-contact-type recording medium restricting device and the overall space required by the apparatus can be reduced. Furthermore, since pressing is carried out by an air flow from a state where the recording medium is in contact with the transfer drum, then it is possible to perform suctioning rapidly.

Desirably, the non-contact-type recording medium restricting device includes: a first non-contact-type recording medium restricting device which is provided inside the transfer drum; and a second non-contact-type recording medium restricting device which is provided on an outer circumferential surface side of the pressure drum.

According to this aspect, the recording medium is pressed by non-contact-type recording medium restricting devices in two locations, and therefore the recording medium can be restricted more reliably.

Desirably, an image is formed on the recording medium by an inkjet head.

The recording medium conveyance apparatuses are suitable for use with a recording medium on which an image has been formed by an inkjet head. Since the recording medium is pressed against the conveyance body in a non-contact fashion, then it is possible to press a recording medium on which an image has been formed by an inkjet head, without destroying the image.

Desirably, the recording medium conveyance apparatus further comprises a heating device which heats the air flow supplied by the air blowing device.

According to this aspect, by supplying an air flow that has been heated by a heating device, drying of the ink on the recording medium can be promoted and therefore it is possible to reduce cockling and the occurrence of wrinkles can be suppressed.

Desirably, the non-contact-type recording medium restricting device is divided into a plurality of sections in a width direction of the recording medium, pressing force in each of the plurality of sections being controllable in accordance with image data.

According to this aspect, the non-contact-type recording medium restricting device is divided in terms of the width direction of the recording medium and the pressing force is adjusted in each of the respective sections in accordance with the image data, and therefore it is possible to suppress wrinkles in locations of large droplet ejection volume in an effective manner.

Desirably, the suctioning device is divided into a plurality of sections in a width direction of the recording medium, suctioning force in each of the plurality of sections being controllable in accordance with image data.

According to this aspect, the suctioning device is divided in the width direction of the recording medium and the suctioning force of each of the sections is adjusted in accordance with the image data, and therefore it is possible to suppress wrinkles in locations of large droplet ejection volume in an effective manner.

In order to attain an object described above, another aspect of the present invention is directed to a recording medium conveyance method comprising: a conveyance step of conveying a recording medium while performing suctioning from a conveyance body having curvature via suction holes in a state where the recording medium is carried on the conveyance body and a conveyance direction leading end of the recording medium is held; a non-contact-type recording medium restricting step of pressing in a non-contact fashion the recording medium from an opposite side of the recording medium to the conveyance body; and a control step of controlling a pressing position in the non-contact-type recording medium restricting step and a suctioning position of the suctioning in accordance with a type of the recording medium.

Desirably, in the control step, the suction position is set further to a downstream side with respect to the pressing position in terms of a direction of conveyance as the recording medium exhibits lower rigidity.

Desirably, the non-contact-type recording medium restricting step is an air blowing step of supplying an air flow in such a manner that an air flow direction is from a downstream side toward an upstream side in terms of a direction of conveyance of the recording medium.

Desirably, an image is formed on the recording medium by an inkjet head.

The recording medium conveyance method described above is a development of the recording medium conveyance apparatus described above, and is able to provide the same beneficial effects as the recording medium conveyance apparatus.

According to the image forming apparatus and the image forming method of a mode of the present invention, by increasing the viscosity of ink by means of an aggregating agent, the durability of an image can be improved with respect to pressing from the printing surface side, and the trailing end of the recording medium can be restricted. Therefore, it is possible both to restrict the trailing end of the recording medium and to avoid damage to the image, at the same time, in the case of a recording medium having high rigidity. Furthermore, with a recording medium having low rigidity, due to the increase in the viscosity of the ink produced by the aggregating action, the ink in a liquid state can be prevented from flowing into the recesses which occur in the regions of the suction holes, and therefore it is possible to suppress the occurrence of density non-uniformities.

Moreover, according to the recording medium conveyance apparatus and the recording medium conveyance method of a mode of the present invention, since suctioning can be performed onto the conveyance body in a state where wrinkles are suppressed during conveyance on a curved surface, then the recording medium can be held in a state of tight adherence on the surface of the conveyance body and stable conveyance of the recording medium can be performed.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

First Mode

A desirable mode of an image forming apparatus and an image forming method relating to an embodiment of the present invention is described below with reference to accompanying drawings. In the embodiment described below, an inkjet recording apparatus is given as one example of an image forming apparatus, but the present invention is not limited to this and it is also possible to use any other apparatuses which convey a recording medium on curved surfaces after image formation. Furthermore, conveyance on a curved surface is not limited to drum conveyance, and the present invention can also be used in the case of belt conveyance, and the like.

General Composition of Inkjet Recording Apparatus

Firstly, the general composition of an inkjet recording apparatus to which an embodiment of the present invention is applied will be described.

Figure 1:
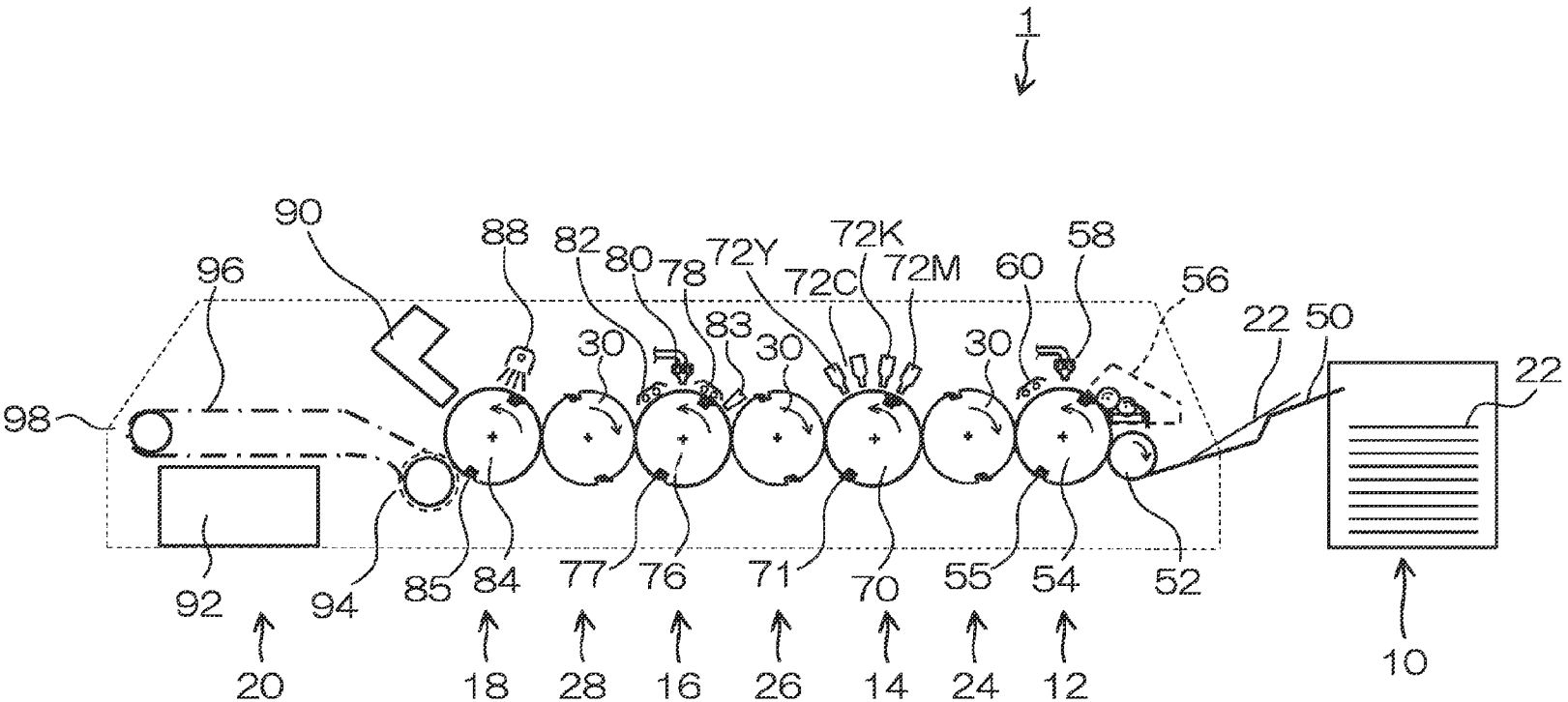
FIG. 1 is a schematic drawing of an inkjet recording apparatus including a recording medium conveyance apparatus according to an embodiment of the present invention.

FIG. 1 is a schematic view of an inkjet recording apparatus 1 according to the present embodiment. The inkjet recording apparatus 1 shown in FIG. 1 is an apparatus which forms an image on a recording surface of a recording medium 22, and mainly includes a paper supply unit 10, a treatment liquid deposition unit 12, an image formation unit 14, a drying unit 16, an exposure curing unit 18 and an output unit 20. The recording media 22 (cut sheet paper) are stacked in the paper supply unit 10. Each recording medium 22 is supplied from the paper supply unit 10 to the treatment liquid deposition unit 12, treatment liquid is deposited on the recording surface by the treatment liquid deposition unit 12, and then colored inks are deposited onto the recording surface by the image formation unit 14. The water content of the recording medium 22 on which ink has been deposited is dried by the drying unit 16, whereupon the image is made durable by the exposure curing unit 18 and is then conveyed by the output unit 20.

Intermediate conveyance units (transfer drums) 24, 26, 28 are provided between these respective units, and the recording medium 22 is transferred by these intermediate conveyance units 24, 26, 28. More specifically, a first intermediate conveyance unit 24 is provided between the treatment liquid deposition unit 12 and the image formation unit 14, and the recording medium 22 is transferred from the treatment liquid deposition unit 12 to the image formation unit 14 by this first intermediate conveyance unit 24. Similarly, a second intermediate conveyance unit 26 is provided between the image formation unit 14 and the drying unit 16, and the recording medium 22 is transferred from the image formation unit 14 to the drying unit 16 by this second intermediate conveyance unit 26. Moreover, a third intermediate conveyance unit 28 is provided between the drying unit 16 and the exposure curing unit 18, and the recording medium 22 is transferred from the drying unit 16 to the exposure curing unit 18 by this third intermediate conveyance unit 28.

Below, respective units of the inkjet recording apparatus 1 (the paper supply unit 10, the treatment liquid deposition unit 12, the image formation unit 14, the drying unit 16, the exposure curing unit 18, the output unit 20, the first to third intermediate conveyance units 24, 26, 28) will be described.

Paper Supply Unit

The paper feed unit 10 is a mechanism which supplies a recording medium 22 to the image formation unit 14. A paper supply tray 50 is provided with the paper supply unit 10, and the recording medium 22 is supplied one sheet at a time to the treatment liquid deposition unit 12 from the paper supply tray 50.

Treatment Liquid Deposition Unit

The treatment liquid deposition unit 12 is a mechanism which deposits treatment liquid onto a recording surface of the recording medium 22. The treatment liquid includes a coloring material aggregating agent which aggregates or precipitates the coloring material (pigment) in the ink deposited by the image formation unit 14, and the separation of the ink into the coloring material and the solvent is promoted due to the treatment liquid and the ink making contact with each other. A more detailed description of the treatment liquid is given below.

As shown in FIG. 1, the treatment liquid deposition unit 12 includes a transfer drum 52, a treatment liquid drum 54, a treatment liquid application apparatus 56, an IR heater 58 and a hot air flow blowing nozzle 60. The transfer drum 52 is disposed between the paper supply tray 50 of the paper supply unit 10 and the treatment liquid drum 54, a hook-shaped holding device (gripper, or the like) is provided on the outer circumferential surface thereof, and the recording medium 22 is conveyed in rotation while the leading end of the recording medium is held by the holding device. The recording medium 22 supplied from the paper supply unit 10 is received by the transfer drum 52 and transferred onto the treatment liquid drum 54.

The treatment liquid drum 54 is a drum which holds the recording medium 22 and conveys the medium by rotation, and this drum is driven so as to rotate. Furthermore, the treatment liquid drum 54 includes a hook-shaped holding device 55 provided on the outer circumferential surface of the drum, in such a manner that the leading end of the recording medium 22 can be held by the holding device 55. The recording medium 22 is conveyed by rotation due to the treatment liquid drum 54 rotating in a state where the leading end is held by the holding device 55. On the outside of the treatment liquid drum 54, a treatment liquid application apparatus (corresponding to an application apparatus) 56, an IR heater 58 and a hot air flow blowing nozzle 60 are provided opposing the outer circumferential surface of the treatment liquid drum 54. The treatment liquid application apparatus 56, the IR heater 58 and the hot air flow blowing nozzle 60 are disposed in sequence from the upstream side in the direction of rotation of the treatment liquid drum 54 (the counter-clockwise direction in FIG. 1), and the recording medium 22 is firstly coated with the treatment liquid on the recording surface thereof by the treatment liquid application apparatus 56. The film thickness of the treatment liquid is desirably sufficiently smaller than the diameter of the ink droplets which are ejected from the inkjet heads 72M, 72K, 72C and 72Y of the image formation unit 14. For example, if the droplet ejection volume of the ink is 2 pl, then the average diameter of the droplets is 15.6 μm. In this case, if the film thickness of the treatment liquid is large, then the ink dots float inside the treatment liquid without making contact with the surface of the recording medium 22. Therefore, in order to obtain a diameter of 30 μm or more in the deposited dots when the ink droplet ejection volume is 2 pl, it is desirable that the film thickness of the treatment liquid should be 3 μm or less.

The recording medium 22 onto which the treatment liquid has been applied with the treatment liquid application apparatus 56 is conveyed to the position of the IR heater 58 and the hot air flow blowing nozzle 60. The IR heater 58 is controlled to a high temperature (for example, 180° C.) and the hot air flow blowing nozzle 60 is composed so as to blow a hot air flow at a high temperature (for example, 70° C.) onto the recording medium 22 at a uniform flow rate (for example, 9 $m^3$/min) The heating by means of the IR heater 58 and the hot air flow blowing nozzle 60 evaporates off the water content in the solvent of the treatment liquid, and a thin film layer of the treatment liquid is formed on the recording surface. By forming the treatment liquid as a thin layer in this way, when dots of ink formed by droplets ejected from the image formation unit 14 make contact with the recording surface of the recording medium 22, the required dot diameter is obtained, and furthermore aggregation of the coloring material occurs due to reaction with the treatment liquid component formed in a thin layer and hence an action of fixing the coloring material to the recording surface of the recording medium 22 can be achieved readily. The treatment liquid drum 54 may be controlled to a prescribed temperature (for example, 50° C.).

Image Formation Unit

As shown in FIG. 1, the image formation unit 14 includes an image formation drum 70, and inkjet heads 72M, 72K, 72C and 72Y disposed in close proximity to the image formation drum 70 at positions opposing the outer circumferential surface of the image formation drum 70. The inkjet heads 72M, 72K, 72C and 72Y correspond respectively to the four colors of magenta (M), black (K), cyan (C) and yellow (Y), and are arranged sequentially from the upstream side in terms of the direction of rotation of the image formation drum 70.

The image formation drum 70 is a drum which holds the recording medium 22 on the outer circumferential surface thereof and conveys the medium by rotation, and this drum is driven so as to rotate. Furthermore, the image formation drum 70 includes a hook-shaped holding device 71 provided on the outer circumferential surface of the drum in such a manner that the leading end of the recording medium 22 can be held by the holding device 71. The recording medium 22 is conveyed by rotation due to the image formation drum 70 rotating in a state where the leading end is held by the holding device 71. During this, the recording medium 22 is conveyed with the recording surface thereof facing outwards, and ink is deposited onto this recording surface from the inkjet heads 72M, 72K, 72C and 72Y.

The inkjet heads 72M, 72K, 72C and 72Y are each full-line type inkjet recording heads (inkjet heads) having a length corresponding to the maximum width of the image forming region on the recording medium 22, and a nozzle row of nozzles for ejecting ink arranged throughout the whole width of the image forming region is formed in the ink ejection surface of each head. The inkjet heads 72M, 72K, 72Y and 72Y are each disposed so as to extend in a direction perpendicular to the conveyance direction of the recording medium 22 (the direction of rotation of the image formation drum 70).

Cassettes of the corresponding color inks are installed in each of the inkjet heads 72M, 72K, 72C and 72Y. Droplets of the respective inks are ejected from the inkjet heads 72M, 72K, 72C and 72Y toward the recording surface of the recording medium 22 which is held on the outer circumferential surface of the image formation drum 70. By this means, the ink makes contact with the treatment liquid that has been deposited on the recording surface previously by the treatment liquid deposition unit 12, and the coloring material (pigment) dispersed in the ink is aggregated to form a coloring material aggregate. By this means, flowing of coloring material, and the like, on the recording medium 22 is prevented and an image is formed on the recording surface of the recording medium 22. Furthermore, since the image formation drum 70 of the image formation unit 14 is structurally separate from the treatment liquid drum 54 of the treatment liquid application unit 12, the treatment liquid is never deposited onto the inkjet heads 72M, 72K, 72C and 72Y, and it is possible to reduce the causes of ink ejection abnormalities.

One possible example of a reaction between the ink and the treatment liquid uses a mechanism whereby an acid is included in the treatment liquid and the consequent lowering of the pH breaks down the dispersion of pigment and causes the pigment to aggregate, thereby avoiding bleeding of the coloring material, intermixing between inks of different colors, and interference between ejected droplets due to combination of the ink droplets upon landing.

Furthermore, the droplet ejection timings of the inkjet heads 72M, 72K, 72C and 72Y are synchronized with an encoder which determines the speed of rotation and is positioned on the image formation drum 70. By this means, it is possible to specify the depositing position with high accuracy. Moreover, speed variations caused by inaccuracies in the image formation drum 70, or the like, can be ascertained in advance, and the droplet ejection timings obtained by the encoder 91 can be corrected, thereby reducing droplet ejection non-uniformities, irrespective of inaccuracies in the image formation drum 70, the accuracy of the rotational axle, and the speed of the outer circumferential surface of the image formation drum 70.

Furthermore, maintenance operations such as cleaning the nozzle surfaces of the inkjet heads 72M, 72K, 72C and 72Y, expelling ink of increased viscosity, and the like, are desirably carried out with the head unit withdrawn from the image formation drum 70.

Moreover, although a configuration with the four standard colors of C, M, Y and K is described in the present mode, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

Furthermore, in the present mode, desirably, a region where no image is formed is provided in the tailing end of the recording medium 22 in the direction of conveyance. By providing such a region where no image is formed, it is possible to cause the recording medium to adhere tightly to the drying drum 76 by pressing this region with a non-contact-type recording medium restricting device in the drying unit 16, and this can be done without damaging the image.

Drying Unit

The drying unit 16 is used for a step of drying moisture included in the solvent which is separated by the coloring material aggregating action, and includes a drying drum 76, a first IR heater 78 which is disposed at a position opposing the outer circumferential surface of the drying drum 76, a hot air flow spraying nozzle 80, a second IR heater 82, and an air blowing nozzle 83 serving as a non-contact-type of recording medium restricting device which causes the recording medium 22 to adhere tightly to the drying drum 76. The first IR heater 78 is provided to the upstream side of the direction of rotation of the drying drum 76 (the counter-clockwise direction in FIG. 1) with respect to the hot air flow spraying nozzle 80, and the second IR heater 82 is provided to the downstream side of the how air flow spraying nozzle 80. Furthermore, the air blowing nozzle 83 is provided on the furthest upstream side of the drying unit 16, and on the upstream side of the first IR heater 78, in order to cause the recording medium 22 and the drying drum 76 to make tight contact.

The drying drum 76 is a drum which holds a recording medium 22 on the outer circumferential surface thereof and conveys the recording medium by rotation, and the rotation of the drum is driven and controlled by a motor driver (not illustrated). The recording medium 22 is conveyed in rotation by causing the drying drum 76 to rotate in a state where the leading end of the medium is held by the holding device 77. In this step, the recording medium 22 is conveyed with the recording surface of the recording medium 22 facing toward the outside, and a drying process is carried out on the recording surface by the IR heater 78 and the hot air flow spraying nozzle 80.

The hot air flow spraying nozzle 80 is composed in such a manner that a hot air flow controlled to a prescribed temperature (for example, 50° C. to 70° C.) is blown at a prescribed air flow volume (12 $m^3$/min.) onto the recording medium 22, and the IR heater 78 is controlled respectively to a prescribed temperature (for example, 180° C.). The water contained in the print surface of the recording medium 22 held on the drying drum 76 is evaporated off by the hot air flow spraying nozzle 80 and the IR heater 78, thereby performing a drying process. In this step, since the drying drum 76 of the drying unit 16 is structurally separate from the image formation drum 70 of the image formation unit 14, then it is possible to reduce ink ejection failures caused by drying of the head meniscus portion due to drying by heat in the inkjet heads 72M, 72K, 72C and 72Y. Furthermore, the temperature of the drying unit 16 can be set freely, and an optimal drying temperature can therefore be set.

The evaporated water is desirably expelled to the exterior of the machine with the air by means of an expulsion device, which is not illustrated. Furthermore, the recovered air may be cooled by the cooler (radiator), or the like, and the liquid therein may be recovered.

The drying drum 76 includes suction holes provided in the outer circumferential surface thereof, and has a suctioning device which performs suctioning via the suction holes. By this means, it is possible to hold the recording medium 22 tightly against the circumferential surface of the drying drum 76. Furthermore, it is possible to hold the recording medium against the conveyance body by carrying out negative pressure suctioning, and therefore it is possible to prevent cockling of the recording medium.

Furthermore, the outer circumferential surface of the drying drum 76 is desirably controlled to a prescribed temperature. By heating from the rear surface of the recording medium 22, drying is promoted and breaking of the image during fixing can be prevented. The range of the surface temperature of the drying drum 76 is desirably not lower than 50° C., and more desirably, not lower than 60° C. Furthermore, although there are no particular restrictions on the upper limit, from the viewpoint of the safety of maintenance work (preventing burns due to hot temperature), such as cleaning the ink adhering to the surface of the drying drum 76, an upper temperature limit of no higher than 75° C. is desirable.

The suctioning force of the conveyance body can be expressed as (opening surface area)×(pressure per unit surface area). The suctioning force can be raised further by increasing the surface area occupied by the suction holes in the recording medium suction holding region, in other words, by raising the opening ratio.

The opening ratio of the suction holes is desirably not less than 1% and not more than 75%, and more desirably, not less than 10% and not more than 50%, with respect to the contact surface area between the conveyance body and the recording medium. By setting the opening ratio to the range described above, it is possible to suppress cockling and to improve drying performance. If the opening ratio is less than 1%, then it is difficult adequately to suppress swelling deformation of the recording medium caused by absorption of water after recording. Furthermore, if the opening ratio exceeds 75%, then the contact surface area between the rear surface of the recording medium and the front surface of the conveyance body decreases, and therefore it is not possible to obtain sufficient drying performance even when the medium is in a state of being held by suction. Moreover, since drying does not progress, then cockling also tends to become worse.

The opening ratio can be controlled by means of the diameter, pitch, shape and arrangement of the suction holes. The hole diameter is desirably no smaller than 0.4 mm in order to ensure the opening ratio and raise the suctioning force, and is desirably not greater than 1.5 mm so that depression marks (suctioning marks) are not left in the recording medium due to the negative pressure suctioning. Furthermore, the hole pitch is desirably set to be not less than 0.1 mm in order to prevent thermal deformation of the surface of the conveyance body and ensure the rigidity, and is desirably set to be not greater than 10 mm in order to prevent wrinkles which occur during suctioning if the gaps between the holes are too large and the effect in suppressing deformation of the recording medium is insufficient.

If the shape of the suction holes is a square (acute) shape, then stress is concentrated in the corner portion, and therefore it is desirable to form the corner portions with a rounded shape. Furthermore, in a rotating conveyance body, the amount of deformation of the recording medium due to the suctioning pressure is greater in the axial direction than in the circumferential direction. Consequently, it is possible to make the deformation of the recording medium in the circumferential direction and the deformation thereof in the axial direction equal by forming the suction holes as elliptical or elongated holes having a long axis in the circumferential direction and a short axis in the axial direction.

In the present mode, the air blowing nozzle 83 is provided as a non-contact-type recording medium restricting device in order to cause the recording medium 22 to be held stably in tight contact with the drying drum 76 which has curvature. For the non-contact-type recording medium restricting device, it is possible to use an air blowing device such as the air blowing nozzle 83 shown in FIG. 1, or the like. Furthermore, it is also possible to use a known air blowing device, such as a blower, fan, or the like, as the air blowing device. By restricting the trailing end of a recording medium by means of a non-contact-type recording medium restricting device, the recording medium is pressed and caused to adhere tightly to the conveyance body which has curvature. Furthermore, the viscosity of the ink in the formed image can be increased by depositing treatment liquid containing an aggregating agent by means of the treatment liquid deposition unit 12. Therefore, if the recording medium has high rigidity, then even if the pressing force exerted by the non-contact-type recording medium restricting device is high, it is still possible to convey the recording medium without causing damage to the image. Furthermore, if the rigidity of the recording medium is low, then when suctioning is performed from the conveyance body side of the recording medium, although there has been some occurrence of depression of the recording medium, flowing of the ink and density non-uniformities in the image, due to the suctioning at the region of the suction holes, the viscosity of the ink is raised by aggregating the ink, and therefore density non-uniformities in the image can be suppressed.

Figure 2:
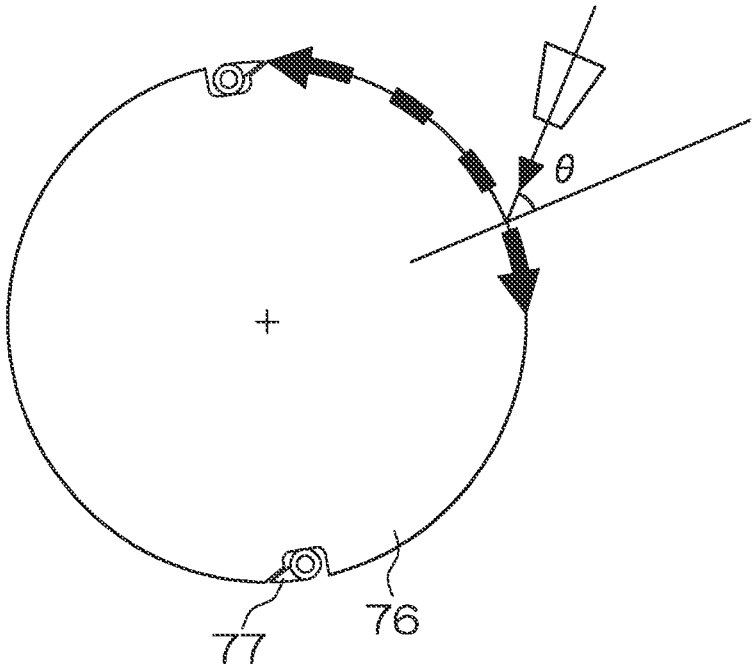
FIG. 2 is an enlarged diagram of a recording medium conveyance apparatus (drying unit) relating to a first embodiment of a first mode and a first embodiment of a second mode.

FIG. 2 shows an enlarged view of the drying unit 16. As described above, the drying unit 16 includes suction holes provided in the outer circumferential surface of the drying drum 76, and it is also possible to control the suctioning start position on the recording medium 22 by the suction holes. The suctioning start position is desirably set in such a manner that the range indicated by the arrow on the outer circumference of the drying drum 76 in FIG. 2 is the suctioning start position. Moreover, desirably, the positional relationship between the pressing position and the suctioning start position is controlled in accordance with the diameter of the drum, and the size and rigidity of the recording medium. Desirably, the suctioning start position is situated further to the downstream side of the air blowing position in terms of the conveyance direction as the recording medium exhibits lower rigidity. If suctioning is performed to the downstream side of the conveyance direction, then a recording medium having low rigidity can be suctioned after wrinkles have been adequately suppressed. Moreover, if the recording medium has high rigidity, then it is possible to perform stable suctioning of the recording medium of high rigidity by starting suctioning before pressing with a non-contact-type recording medium restricting device.

If the position of the non-contact-type recording medium restricting device is fixed, then the suctioning start position can be controlled with respect to the pressing position by controlling the timing at which suctioning is started by the suctioning device of the drying drum 76. Furthermore, if the suction timing is fixed, then the suctioning start position can be controlled by arranging the air blowing nozzle 83 so as to be movable in the conveyance direction.

Desirably, the pressing force (air flow pressure) of the non-contact-type recording medium restricting device is controlled in accordance with the rigidity of the recording medium. It is possible to avoid damage to the image by a strong air flow, by controlling the pressing force. Furthermore, it is also possible to adjust the pressing force (air flow pressure) of the non-contact-type recording medium restricting device in accordance with the position of the recording medium. For example, it is possible to increase the pressing force (air flow pressure) toward the trailing end of the recording medium in the conveyance direction, or to perform intermittent air blowing in which pressing (blowing of an air flow) is performed only when the trailing end of the recording medium is passing, and the region apart from the trailing end is a region where air blowing is not performed. By controlling the pressing force, it is possible to shorten the time during which the image is pressed by the non-contact-type recording medium restricting device and to avoid unnecessary pressing, and therefore it is possible to reduce damage to the image.

Desirably, the air flow velocity produced by the air blowing device is in the range of 5 to 200 (m/s). If the air flow velocity is lower than 5 (m/s), then the effect in suppressing wrinkles is insufficient, and if the air flow velocity is greater than 200 (m/s), then in cases where the ink deposition volume is large in the image portion and in a state where the ink has not yet dried, there is a concern that the image can be damaged by the blown air flow. It is possible to blow air onto an image in a dried state without any particular restrictions. The air flow velocity is measured by measuring the flow speed V (m/s) at a distance equivalent to the gap from the air flow outlet of the air blowing device (the air nozzle outlet port, or the like) to the surface of the recording medium. The air flow velocity can be measured using an Anemomaster Model 6004 (anemometer) manufactured by Kanomax group, for example.

The air flow volume required in the air blowing device varies with the width and thickness of the recording medium, but desirably, is in the range of 0.1 to 2 ($m^3$/min) for a recording medium of half Kiku size (636 mm×469 mm), for example. The air flow volume is calculated by the following equation from the measurement value of the air flow velocity. The air flow velocity (air flow volume) can be adjusted by regulating the pressure by means of a regulator in the case of compressed air, or by controlling the blower input power in the case of a blower device.

$$Q=V\times A\times 60(m^3/\text{min})$$

(Q: air flow volume ($m^3$/min), V: air flow velocity (m/s), and A: air flowing surface area ($m^2$))

Figure 3A:
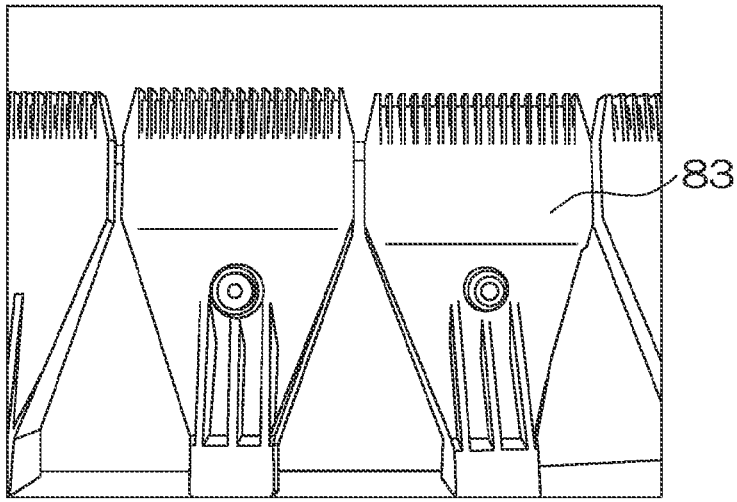
FIGS. 3A and 3B are schematic drawings of an air blowing nozzle.
Figure 3B:
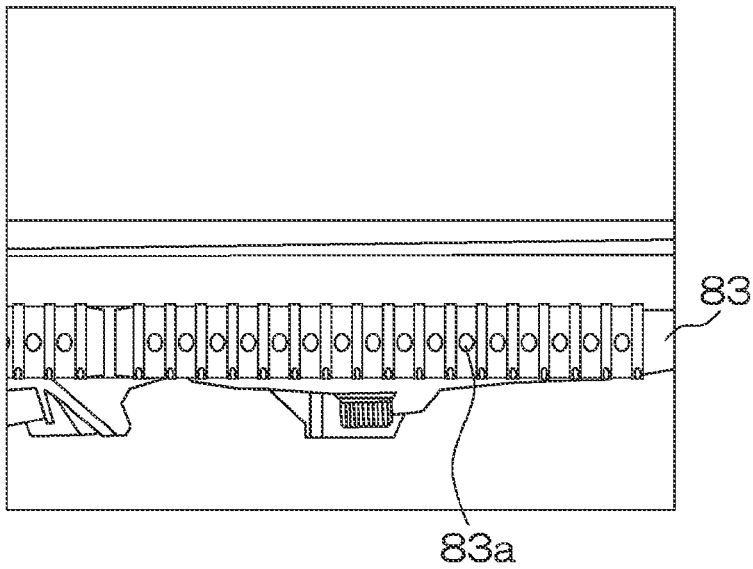

The non-contact-type restricting device is able to perform air blowing by joining together air blowing nozzles 83 as shown in FIGS. 3A and 3B, for example, (nozzle width: 50 mm per nozzle), in the width direction of the recording medium, but there are no particular restrictions on the shape and material of the members used, provided that a desired air flow velocity (air flow volume) is obtained. However, with regard to the material, a heat-resistant material is desirable if the non-contact-type recording medium restricting device is to be provided in the vicinity of the drying device, or is to serve also as a drying device as described hereinafter.

FIG. 3B is a diagram showing the shape of nozzle opening sections 83*a*. FIG. 3B is a diagram of a case where a plurality of fine round holes (nozzle diameter: 1.2 mm) are arranged as the opening sections 83*a*; however, there are no particular restrictions on the shape and size thereof, and it is also possible to increase the nozzle diameter of the opening sections 83*a* in order to blow air over a broader region, and the shape is not limited to a round shape and may also be a square shape.

The distribution of the air flow velocity (air flow volume) can also be changed by means of the individual nozzles. For example, the air flow velocity can be increased in the image area so as to suppress floating up, and can be reduced in the non-image area. Furthermore, if the size of the recording medium varies, then it is possible to perform air blowing only in the portion corresponding to the length in the width direction of the recording medium. By supplying an air flow to the region of the side face portion of the conveyance body where the recording medium does not pass, it is possible to prevent the air flow from entering into the rear surface of the recording medium and giving rise to floating up or disorderly conveyance of the recording medium.

Figure 4:
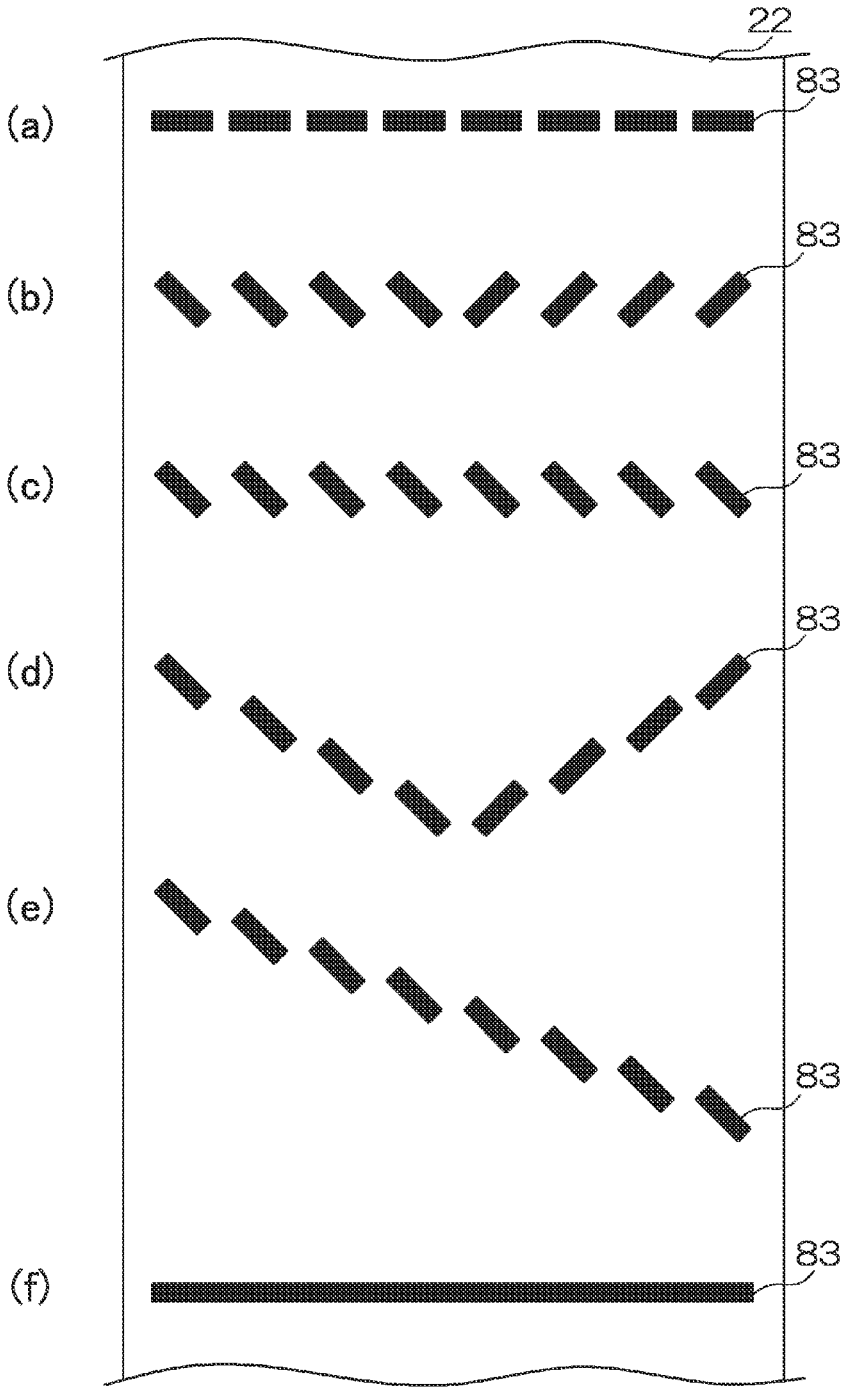
FIG. 4 is a plan diagram showing orientations and arrangements of air blowing nozzles.

FIG. 4 is a plan diagram showing orientations and arrangements of individual nozzles 83. An air flow is sprayed out toward the recording medium 22. (a) of FIG. 4 is a normal nozzle arrangement without any rotation of the nozzles. The individual nozzles 83 can be rotatable, and can be rotated so as to be inclined from the center toward either end portion of the recording medium, as shown in (b) of FIG. 4, for example, or from one end portion toward the other end portion as shown in (c) of FIG. 4. By adopting the arrangement shown in (b) or (c) of FIG. 4, it is possible to disperse wrinkles toward the end portions in the width direction of the recording medium, or to expel wrinkles to the end portions in the width direction.

Furthermore, the individual nozzles do not have to be arranged in the same row in the width direction of the recording medium, and may also be arranged in such a manner that an air flow is blown successively from the center toward either end portion of the recording medium, as shown in (d) of FIG. 4, or from one end portion toward the other end portion, as shown in (e) of FIG. 4. By adopting an arrangement of this kind, it is possible further to enhance the effect of dispersing wrinkles toward the end portions in the width direction of the recording medium or expelling wrinkles to the end portions in the width direction.

(a) to (e) of FIG. 4 show a mode including a plurality of nozzles 83, but as shown in (f) of FIG. 4, it is also possible to use a nozzle 83 having an opening section of a length equal to the length of the width direction of the recording medium 22. By using one nozzle, the air flow velocity (air flow volume) is standardized (equalized), and it is possible to avoid local concentration of wrinkles, for example.

As shown in FIG. 2, desirably, the orientation of the air flow from the air blowing nozzles 83 is arranged in such a manner that an air flow is blown in an oblique direction from the leading end side toward the trailing end side of the recording medium 22 in terms of the conveyance direction. By this means, it is possible to cause the recording medium 22 to lie along the drying drum 76 and enhance the pressing effect created by the air flow. The air blowing direction is desirably set in such a manner that the angle θ formed between the air blowing direction and the normal to the point at which the air flow makes contact with the recording medium 22 (drying drum 76) is not less than 0° and not more than 75°. If the inclination exceeds the aforementioned range, then the pressing effect is insufficient and therefore such a case is not desirable.

Furthermore, it is also possible to adopt a composition in which the angle θ of the air blowing nozzles 83 can be adjusted. For example, if the recording medium has low rigidity, then aligning the paper with the surface of the conveyance body is prioritized and the angle θ can be made large, whereas if the recording medium has high rigidity, then causing the recording medium to adhere tightly to the surface of the conveyance body is prioritized, and the angle θ can be made small. Furthermore, as shown in FIG. 4, if the non-contact-type recording medium restricting device is constituted by a plurality of air blowing nozzles 83, and the like, then it is possible to adopt a composition where the angle θ can be controlled respectively in each of the air blowing nozzles 83.

Furthermore, the non-contact-type recording medium restricting device may also be combined with a drying device (i.e. the non-contact-type recording medium restricting device may also serve as a drying device). If a drying fan with a built-in heater which blows a hot air flow onto the recording medium from air nozzles is used as the non-contact-type recording medium restricting device, then it is possible to carry out drying. In a drying unit where drying fans are arranged in a plurality of rows in the conveyance direction, the drying conditions can be set by raising the air flow volume of the drying fans in a first row, or increasing the air flow velocity by restricting the openings of the air nozzles, or inclining the air spraying angle toward the upstream side of the direction of conveyance.

Desirably, suctioning is performed in a stepwise fashion from the downstream side of the direction of conveyance (the leading end side of the recording medium). By performing suctioning in a stepwise fashion, the region of the recording medium that has just passed the non-contact-type recording medium restricting device and which has been corrected in terms of wrinkles and floating up (i.e. immediately after the wrinkles and floating up are cured), can be suctioned straight away, and therefore the recording medium can be suctioned uniformly in a more reliable fashion. In cases where the suctioning of the whole suction region of the suctioned surface can only be performed simultaneously (in a lump sum), then if the recording medium has a large size, in the leading end portion of the recording medium, time will have passed since the correction by the non-contact-type recording medium restricting device and wrinkles and floating up may have occurred again, while in the trailing end portion of the recording medium, the recording medium may be suctioned to the conveyance body without wrinkles and floating having been corrected. Therefore, by performing suctioning in a stepwise fashion, it is possible to suction the recording medium onto the conveyance body in a more desirable state, and therefore stable conveyance can be achieved.

Desirably, the air flow blown from the air flow blowing device is heated. By blowing a heated air flow, it is possible to speed up the drying of the recording medium 22, and therefore if the recording medium has low rigidity, it is possible to suppress the occurrence of cockling in the recording medium 22 and to prevent breaking of the image as drying progresses.

Desirably, the air blowing device is divided into a plurality of sections in the width direction of the recording medium 22, and the pressing force (air flow pressure) of each section can be controlled respectively. Similarly, it is desirable that the suctioning device should be divided into a plurality of sections in the width direction of the recording medium 22. By controlling the pressing force produced by the air blowing device and the suctioning force produced by the suctioning device, in accordance with the image data, it is possible to enhance the effect in suppressing wrinkles in locations where the droplet ejection volume is high. Furthermore, it is also desirable to increase the pressing force of each of the air blowing devices and the suctioning force of the respective suctioning devices in sections in the central portion of the width direction of the recording medium 22. Wrinkles are liable to occur in the central portion of the recording medium 22, and therefore by increasing the pressing force and the suctioning force in the central portion of the width direction of the recording medium 22, it is possible to suppress wrinkles in the central portion and hence to prevent wrinkles in the whole of the recording medium.

Second Embodiment

Figure 5:
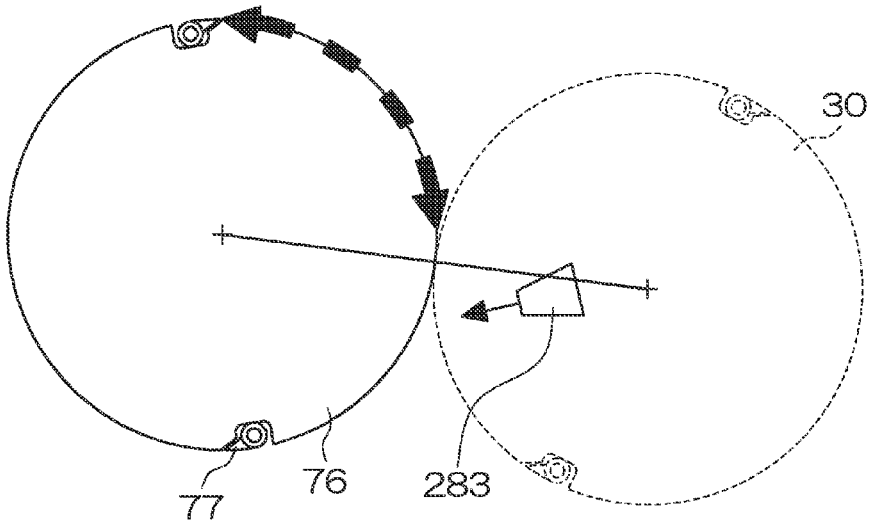
FIG. 5 is an enlarged diagram of a recording medium conveyance layer relating to a second embodiment of the first mode and a second embodiment of the second mode.

FIG. 5 is a schematic drawing of a recording medium conveyance apparatus according to a second embodiment of the invention. The recording medium conveyance apparatus according to the second embodiment differs from that of the first embodiment in that an air blowing nozzle (non-contact-type recording medium restricting device) 283 is provided inside the intermediate conveyance body (transfer drum) 30 which is connected before the drying drum 76.

By providing the air blowing nozzle 283 inside the intermediate conveyance body 30, it is possible reduce the space occupied by the whole inkjet recording apparatus 1. Furthermore, by providing a non-contact-type recording medium restricting device inside the intermediate conveyance body 30, in the case of thin paper, it is possible to press the paper in a position further upstream from the point where the paper is received onto the drying drum 76, and therefore it is possible to start suctioning to the upstream side of the drying drum 76. Consequently, the heating efficiency from the rear surface can be improved on the drying drum 76. Furthermore, if it is implemented on the image formation drum 70, it is possible to reduce the effects of disorderly behavior of the trailing end of the recording medium.

The pressing force of the air flow (air flow pressure) and the air blowing direction produced by the air blowing device can be attained in a similar fashion to the first embodiment.

Third Embodiment

Figure 6:
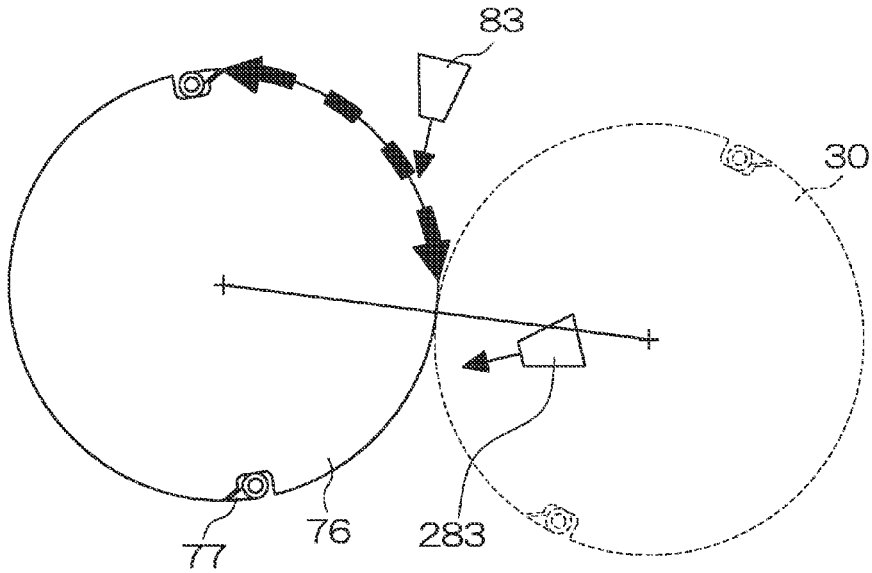
FIG. 6 is an enlarged diagram of a recording medium conveyance layer relating to a third embodiment of the first mode and a third embodiment of the second mode.

FIG. 6 is a plan view perspective diagram of a recording medium conveyance apparatus relating to a third embodiment. The recording medium conveyance apparatus according to the third embodiment differs from those of the first embodiment and the second embodiment in that the non-contact-type recording medium restricting device is constituted by a first non-contact-type recording medium restricting device 283 which is provided inside the intermediate conveyance body 30 and a second non-contact-type recording medium restricting device 83 which is provided on the outer circumferential surface of the drying drum 76.

By providing two non-contact-type recording medium restricting devices—air blowing nozzles (a first non-contact-type recording medium restricting device) 283 and air blowing nozzles (a second non-contact-type recording medium restricting device) 83—in two locations respectively as described in the third embodiment, it is possible to cause the recording medium 22 to adhere tightly to the drying drum 76 in a more reliable fashion and therefore stable conveyance can be achieved.

In the recording medium conveyance apparatus relating to the third embodiment, the pressing force of the air flow (air flow pressure) and the air blowing direction produced by the air blowing nozzles can be achieved by a similar method to that of the first embodiment and the second embodiment.

Furthermore, in the third embodiment, the upstream side of the air blowing position of the suctioning start position means the upstream side of the first non-contact-type recording medium restricting device 283, and the downstream side of the air blowing position means the downstream side of the second non-contact-type recording medium restricting device 83. The same position as the air blowing device means the same position as a position where air blowing is performed by the first air blowing device or the second air blowing device.

The drying unit of an inkjet recording apparatus has been described as one example of a recording medium conveyance apparatus, but the present invention is not limited to this and can also be applied to other cases where it is necessary to suction a recording medium on a curved conveyance body without the occurrence of wrinkles or floating up. For example, in other parts of an inkjet recording apparatus, the present invention can also be used to improve the passage of paper by preventing wrinkles and floating up of a recording medium on an image formation drum, or to suppress wrinkles in the fixing nip of heat rollers by preventing floating up of the recording medium on a fixing drum. Pressing by means of the non-contact-type recording medium restricting device according to the present embodiment has especially beneficial effects in the drying unit, since an image has been formed on the recording medium by the image formation unit 14 and it is difficult to use a roller-based pressing device.

Exposure Curing Unit

The exposure curing unit 18 includes a UV lamp 88 and an in-line sensor 90. The UV lamp 88 and the in-line sensor 90 are disposed at positions opposing the circumferential surface of an exposure curing drum 84, and are arranged in sequence from the upstream side of the direction of rotation of the exposure curing drum 84.

The exposure curing drum 84 is a drum which holds the recording medium 22 on the outer circumferential surface thereof and conveys the medium by rotation, and this drum is driven so as to rotate. Furthermore, the exposure curing drum 84 includes a hook-shaped holding device 85 provided on the outer circumferential surface of the drum, in such a manner that the leading end of the recording medium 22 can be held by the holding device 85. The recording medium 22 is conveyed by rotation due to the exposure curing drum 84 rotating in a state where the leading end is held by the holding device 85. In this step, the recording medium 22 is conveyed with the recording surface thereof facing toward the outside, and the recording surface is subjected to an exposure curing process by the UV lamp 88 and inspection by the in-line sensor 90.

The UV lamp 88 radiates UV light onto the dried ink so as to cure an active light-curable resin contained in the ink, thereby creating a film of the ink. For the UV lamp 88, it is possible to use various ultraviolet sources, such as a metal halide lamp, a high-voltage mercury lamp, a black light, a cold cathode tub, a UV-LED, and the like.

The peak wavelength of the ultraviolet light irradiated by the ultraviolet light source 88 depends on the absorption characteristics of the ink composition, but is desirably 200 to 600 nm, more desirably, 300 to 450 nm, and even more desirably, 350 to 450 nm.

The irradiation energy of the ultraviolet light source 88 is desirably not more than 2000 mJ/cm$^2$, more desirably, 10 to 2000 mJ/cm$^2$, and even more desirably, 20 to 1000 mJ/cm$^2$, and especially desirably, 50 to 800 mJ/cm$^2$.

Furthermore, in the inkjet recording apparatus according to the present embodiment, the ultraviolet light is irradiated onto the recording surface of the recording medium for, desirably, 0.01 to 10 seconds, and more desirably, 0.1 to 2 seconds.

Moreover, the exposure curing drum 84 may be controlled to a prescribed temperature. By this means, the curing sensitivity of the ink can be raised, and the ink can be cured suitably and made into a film at low irradiation intensity.

On the other hand, the in-line sensor 90 is a measurement device for measuring a test pattern (pattern for checking), the amount of moisture, the surface temperature, the glossiness, and the like, with respect to the image fixed on the recording medium 22; and a CCD line sensor, or the like, is employed for the in-line sensor 90.

Output Unit

As shown in FIG. 1, an output unit 20 is provided subsequently to the fixing process unit 18. The output unit 20 includes an output tray 92, and a transfer drum 94, a conveyance belt 96 and a tensioning roller 98 are provided between the output tray 92 and the fixing drum 84 of the fixing unit 18 so as to oppose same. The recording medium 22 is sent to the conveyance belt 96 by the transfer drum 94 and output to the output tray 92.

Intermediate Conveyance Unit

Next, the structure of the first intermediate conveyance unit 24 will be described. The second intermediate conveyance unit 26 and the third intermediate conveyance unit 28 have a similar composition to the first intermediate conveyance unit 24, and description thereof is omitted here.

The first intermediate conveyance unit 24 has the intermediate conveyance body 30. The intermediate conveyance body 30 is a drum for receiving a recording medium 22 from a drum of the preceding stage, conveying the recording medium by rotation, and then transferring the recording medium onto a drum of the subsequent stage. This drum is installed rotatably. Furthermore, the intermediate conveyance body 30 is composed so as to rotate by means of a motor, which is not illustrated.

Hook-shaped holding devices are provided at 90° intervals on the outer circumferential surface of the intermediate conveyance body 30. The holding devices rotate while tracing a circular path, and the leading end of a recording medium 22 is held by the operation of a holding device. Consequently, it is possible to convey the recording medium 22 in rotation by rotating the intermediate conveyance body 30 in a state where the leading end of the recording medium 22 is held by the holding device. Desirably, a plurality of air blowing ports are provided in the surface of the intermediate conveyance body 30, and the recording medium is conveyed with the recording surface of the recording medium being in a non-contact fashion by blowing air out from these air blowing ports.

The recording medium 22 which has been conveyed by the first intermediate conveyance unit 24 is transferred to the drum of the subsequent stage (in other words, the image formation drum 70). In this step, the recording medium 22 is transferred by synchronizing a holding device of the intermediate conveyance unit 24 and a holding device on the image formation unit 14. The recording medium 22 that has been transferred is held and conveyed in rotation by the image formation drum 70.

Furthermore, the first intermediate conveyance unit 24 may also include an internal hot air drying device (drying device) which is not illustrated, and blow a hot air flow onto the recording surface side of the recording medium which faces toward the inside during conveyance, thereby drying the treatment liquid that has been applied to the surface of the medium.

Similarly, the second and third intermediate conveyance units 26 and 28 may also have an internal hot air flow drying device (drying device), which is not illustrated, and blow a hot air flow onto the recording surface side of the recording medium which faces toward the inside during conveyance, thereby drying the ink which has been ejected as droplets onto the surface of the medium.

Description of Control System

Figure 7:
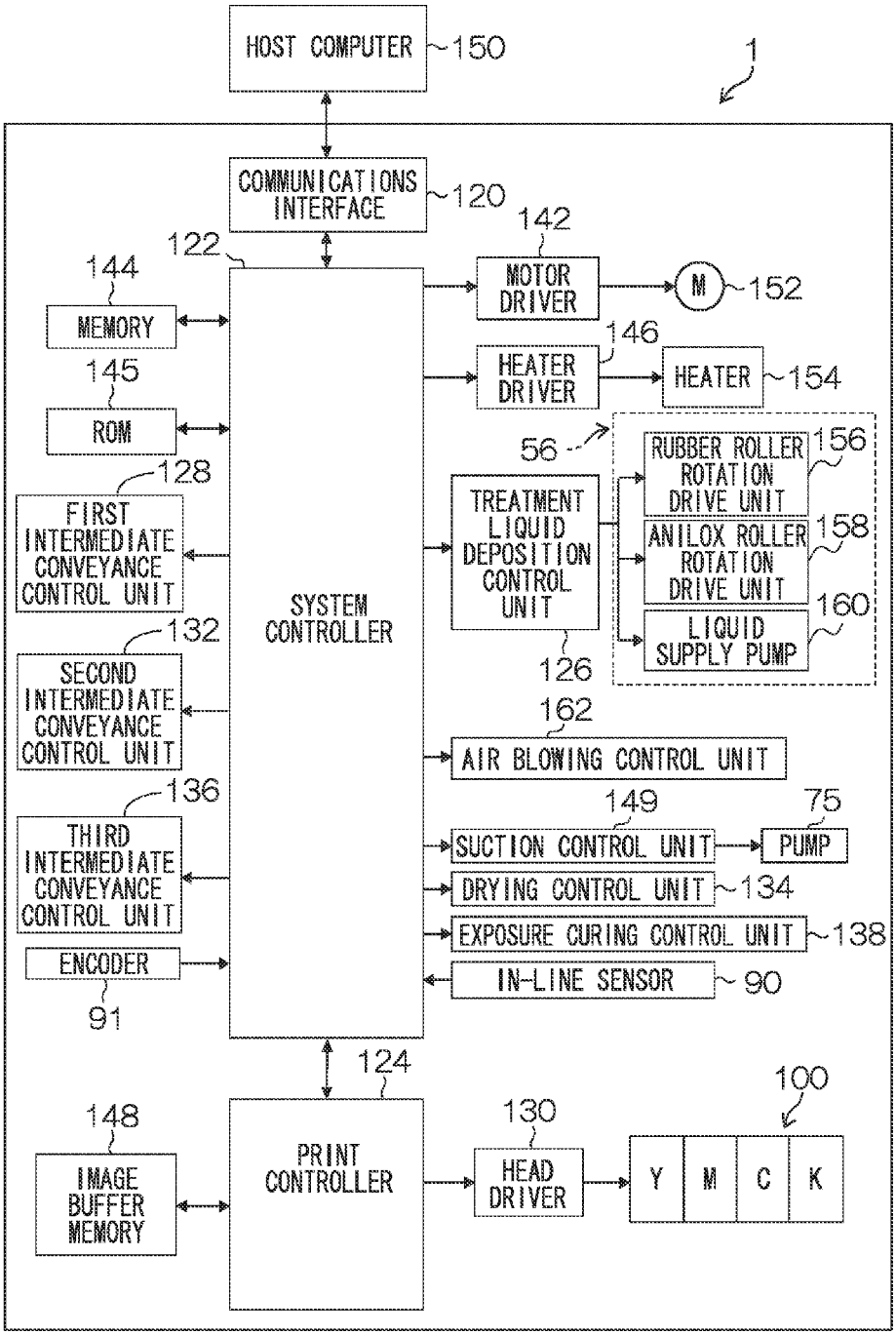
FIG. 7 is a principal block diagram showing the system composition of an inkjet recording apparatus.

FIG. 7 is a principal block diagram showing a system composition of the inkjet recording apparatus 1. The inkjet recording apparatus 1 includes a communications interface 120, a system controller 122, a print controller 124, a treatment liquid deposition control unit 126, a first intermediate conveyance control unit 128, a head driver 130, a second intermediate conveyance control unit 132, a drying control unit 134, a third intermediate conveyance control unit 136, a fixing control unit (exposure curing control unit) 138, an in-line sensor 90, an encoder 91, a motor driver 142, a memory 144, a heater driver 146, an image buffer memory 148, a suction control unit 149, an air blowing control unit 162, and the like.

The communications interface 120 is an interface unit for receiving image data which is transmitted by a host computer 150. For the communications interface 120, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications. Image data sent from the host computer 150 is read into the inkjet recording apparatus 1 via the communications interface 120, and is stored temporarily in the memory 144.

The system controller 122 includes a central processing device (CPU) and a peripheral circuit thereof, and the like, and functions as a controller which controls the whole of the inkjet recording apparatus 1 in accordance with a prescribed program, as well as functioning as a calculation apparatus which performs various calculations. In other words, the system controller 122 controls the respective units, such as the communications interface 120, the treatment liquid deposition control unit 126, the first intermediate conveyance unit 128, the head driver 130, the second intermediate conveyance control unit 132, the drying control unit 134, the third intermediate conveyance control unit 136, the fixing control unit 138, the memory 144, the motor driver 142, the heater driver 146, the suction control unit 149, the air blowing control unit 162, and the like, as well as controlling communications with the host computer 150, controlling reading from and writing to the memory 144, and also generating control signals which control the motors 152 of the conveyance system and heaters 154.

The memory 144 is a storage device which temporarily stores an image input via the communications interface 120, and data is read from and written to this memory via the system controller 122. The memory 144 is not limited to a memory such as a semiconductor element, and may also employ a magnetic medium, such as a hard disk.

Programs to be executed by the CPU of the system controller 122 and various data required for control purposes are stored in the ROM 145. The ROM 145 may be a non-rewriteable storage device, or may be a rewriteable storage device such as an EEPROM. The memory 144 is used as a temporary storage area for image data and also serves as a development area for programs and a calculation work area for the CPU.

The motor driver 142 is a driver which drives the motor 152 in accordance with instructions from the system controller 122. In FIG. 7, the motors arranged in the respective units of the apparatus are represented by the reference numeral 152. For example, the motor 152 shown in FIG. 7 includes motors which drive the rotation of the transfer drum 52 shown in FIG. 1, the treatment liquid drum 54, the image formation drum 70, the drying drum 76, the exposure curing drum 84, the transfer drum 94, and the like, a drive motor of the pump 75 for achieving negative pressure suctioning via the suction holes of the image formation drum 70, and a motor of a withdrawal mechanism of the head units of the inkjet heads 72C, 72M, 72Y and 72K, and the like.

The heater driver 146 is a driver which drives the heater 154 in accordance with instructions from the system controller 122. In FIG. 7, the plurality of heaters which are provided in the inkjet recording apparatus 1 are represented by the reference numeral 154. For example, the heaters 154 shown in FIG. 7 include a pre-heater (not illustrated) for previously heating the recording medium 22 to a suitable temperature in the paper supply unit 10.

The print controller 124 is a control unit which has signal processing functions for carrying out processing, correction, and other treatments to generate a print control signal on the basis of the image data in the memory 144, in accordance with the control of the system controller 122, and which supplies the print data (dot data) thus generated to the head driver 130. Required signal processing is carried out in the print controller 124, and the ejection volume and the ejection timing of the ink droplets in the inkjet head 100 are controlled via the head driver 130 on the basis of the image data. By this means, a desired dot size and dot arrangement are achieved.

An image buffer memory 148 is provided in the print controller 124, and data such as image data and parameters is stored temporarily in the image buffer memory 148 during processing of the image data in the print controller 124. In FIG. 7, the image buffer memory 148 is depicted as being attached to the print controller 124, but may also serve as the memory 144. Furthermore, also possible is a mode in which the print controller 124 and the system controller 122 are integrated to form a single processor.

To give a general description of the processing from image input until print output, the image data that is to be printed is input via the communications interface 120 from an external source and is stored in the memory 144. At this stage, for example, RGB image data is stored in the memory 144.

In the inkjet recording apparatus 1, an image having tones which appear continuous to the human eye is formed by altering the droplet ejection density and dot size of fine dots of ink (coloring material), and therefore it is necessary to convert the tones of the input digital image (light/dark density of the image) into a dot pattern which reproduces the tones as faithfully as possible. In order to achieve this, data of the original image (RGB) accumulated in the memory 144 is sent to the print controller 124 via the system controller 122, and is converted into dot data for each ink color by a half-toning process using a threshold value matrix, error diffusion, or the like, in the print controller 124.

In other words, the print controller 124 carries out processing for converting the input RGB image data into dot data for the four colors of K, C, M and Y. In this way, dot data generated by the print controller 124 is stored in the image buffer memory 148.

The head driver 130 outputs a drive signal for driving the actuators 116 corresponding to the respective nozzles 102 of the inkjet head 100 on the basis of the print data supplied from the print controller 124 (in other words, dot data stored in the image buffer memory 148). The head driver 130 may also include a feedback control system for maintaining uniform drive conditions of the heads.

By applying a drive signal output from the head driver 130 to the inkjet head 100 in this way, ink is ejected from the corresponding nozzles 102. An image is formed on a recording medium 22 by controlling ink ejection from the inkjet head 100 while conveying the recording medium 22 at a prescribed speed.

Furthermore, the system controller 122 controls the treatment liquid deposition control unit 126, the first intermediate conveyance control unit 128, the second intermediate conveyance control unit 132, the drying control unit 134, the third intermediate conveyance control unit 136, the fixing control unit 138, the suction control unit 149 and the air blowing control unit 162.

The treatment liquid deposition control unit 126 controls the operation of the treatment liquid application apparatus 56 of the treatment liquid deposition unit 12 in accordance with instructions from the system controller 122.

The first intermediate conveyance control unit 128 controls the operation of the intermediate conveyance body 30 of the first intermediate conveyance unit 24 in accordance with instructions from the system controller 122. More specifically, the first intermediate conveyance control unit 128 controls the driving of the rotation of the intermediate conveyance body 30 itself, and the rotation of the holding devices which are provided on the intermediate conveyance body 30, and the like. The second intermediate conveyance control unit 132 and the third intermediate conveyance control unit 136 also perform similar control to the first intermediate conveyance control unit 128.

The suction control unit 149 and the air blowing control unit 162 control the suctioning device and the air blowing device 83 which are provided inside the drying drum 76 in accordance with control implemented by the system controller 122, in order to convey the recording medium 22 on which an image has been formed in a state of tight adherence to the drying drum 76. In the suctioning device and the air blowing device 83, the suctioning start position by the suctioning device and the air blowing position by the air blowing device 83 are controlled in accordance with the rigidity of the recording medium 22. The suctioning start position can be controlled by the suction control unit 149 by operating the pump 75 when the recording medium has passed the suctioning start position. The suctioning force produced by the suctioning device and the pressing force (air flow pressure) produced by the air blowing device are controlled in accordance with the type of recording medium 22. The suctioning force and the pressing force corresponding to the rigidity of the recording medium are recorded in the ROM 145, and control can be implemented by directly inputting the type of recording medium 22 used, via a personal computer (not illustrated).

Furthermore, the suctioning force produced by the suctioning device and the pressing force (air flow pressure) produced by the air blowing device are controlled on the basis of the image data in the memory 144 or the print data (dot data) generated by the print controller 124. Moreover, the suctioning force and the pressing force (air flow pressure) are controlled in the width direction of the recording medium.

Ink Composition

The ink composition in the present mode includes a pigment, and can be composed by also using a dispersant, a surfactant, and other components, according to requirements. In the present invention, in order to improve the durability of the image, it is also possible to make the ink less liable to wet and spread on the recording medium by raising the viscosity or surface tension of the ink liquid. For example, of the components listed below, it is desirable to increase the dispersed particle components, such as pigment or resin particles, since this not only increases the viscosity of the ink liquid, but also speeds up aggregation and can be expected to enhance the strength of the actual aggregate body.

Pigment

The ink composition in the present invention contains at least one type of pigment as a coloring material component. There are no particular restrictions on the pigment, and it is possible to select a pigment appropriately according to the object, and for example, the pigment may be an organic or inorganic pigment. It is desirable from the viewpoint of ink coloring properties that the pigment should be one which is virtually insoluble in water or has poor solubility in water.

Dispersant

The ink composition according to the present embodiment may include at least one type of dispersant. As the pigment dispersant, it is possible to use either a polymer dispersant or a low-molecular surfactant type dispersant. Furthermore, the polymer dispersant may be a water-soluble dispersant or a water-insoluble dispersant.

The weight-average molecular weight of the polymer dispersant is desirably 3,000 to 100,000, more desirably, 5,000 to 50,000, yet more desirably, 5,000 to 40,000, and especially desirably, 10,000 to 40,000.

The acid value of the polymer dispersant is desirably not more than 100 mg KOH/g, from the viewpoint of achieving good aggregating properties upon making contact with the treatment liquid. Furthermore, the acid value is more desirably 25 to 100 mg KOH/g, yet more desirably, 25 to 80 mg KOH/g, and especially desirably, 30 to 65 mg KOH/g. If the acid value of the polymer dispersant is not less than 25, then the self-dispersing properties thereof have good stability.

From the viewpoint of self-dispersing properties and the aggregation speed upon contact with the treatment liquid, the polymer dispersant desirably includes a polymer having a carboxyl group, and more desirably includes a polymer having a carboxyl group with an acid value of 25 to 80 mg KOH/g.

In the present mode, from the viewpoint of the lightfastness and the quality of the image, and the like, desirably, a pigment and a dispersant are included, more desirably, an organic pigment and a polymer dispersant are included, and especially desirably, an organic pigment and a polymer dispersant having a carboxyl group are included. Furthermore, from the viewpoint of aggregating properties, desirably, the pigment is coated with a polymer dispersant having a carboxyl group and is insoluble in water. Moreover, from the viewpoint of aggregating properties, desirably, the acid value of the self-dispersing polymer particles which are described hereinafter is smaller than the acid value of the above-described polymer dispersant.

The average particle size of the pigment is desirably 10 to 200 nm, more desirably, 10 to 150 nm, and yet more desirably, 10 to 100 nm. Good color reproduction and good droplet ejection characteristics when ejecting by an inkjet method are obtained if the average particle size is not greater than 200 nm, and good lightfastness is obtained if the average particle size is not less than 10 nm. Furthermore, there are no particular restrictions on the particle size distribution of the coloring material, and it is possible to have a broad particle size distribution or a mono-disperse particle size distribution. Furthermore, it is also possible to combine and use two or more types of coloring material having a mono-disperse particle size distribution.

The average particle size and the particle size distribution of the pigment particles can be determined by measuring the volume-average particle size by dynamic light scattering using a UPA-EX150 Nanotrac particle size distribution analyzer (measurement device) manufactured by NIKKISO CO., LTD.

It is possible to use one type of pigment or two or more type of pigments in combination.

From the viewpoint of image density, the content of the pigment in the ink composition is desirably, 1 to 25 percent by mass, more desirably, 2 to 20 percent by mass, yet more desirably, 5 to 20 percent by mass, and especially desirably, 5 to 15 percent by mass, with respect to the ink composition.

Polymer Particles

The ink component of the present mode may include polymer particles of at least one type. The polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image.

In order to react with the aggregating agent, polymer particles having an anionic surface charge can be used, and a commonly known latex can be used, provided that adequate reactivity and ejection stability can be obtained; however, it is especially desirable to use self-dispersing polymer particles.

Self-Dispersing Polymer Particles

Desirably, the ink composition in the present mode includes at least one type of self-dispersing polymer particles as the polymer particles. The self-dispersing polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image. Furthermore, the self-dispersing polymer comprises resin particles which are desirable from the viewpoint of the ejection stability and the stability of the liquid composition containing the pigment (and in particular, dispersion stability).

Self-dispersing polymer particles means particles of a water-insoluble polymer which does not contain free emulsifier and which can be obtained as a dispersion in an aqueous medium due to a functional group (particularly, an acid group or salt thereof) contained in the polymer itself, without the presence of another surfactant.

The acid value of the self-dispersing polymer in the present mode is desirably not more than 50 KOH mg/g, from the viewpoint of achieving good aggregating properties upon making contact with the treatment liquid. Moreover, the acid value is more desirably 25 to 50 KOH mg/g, and even more desirably, 30 to 50 KOH mg/g. If the acid value of the self-dispersing polymer is not less than 25 mg KOH/g, then the self-dispersing properties thereof have good stability.

From the viewpoint of self-dispersion properties and the aggregation speed upon contact with the treatment liquid, the particles of self-dispersing polymer in the present mode desirably include a polymer having a carboxyl group, more desirably include a polymer having a carboxyl group and an acid value of 25 to 50 KOH mg/g, and even more desirably include a polymer having a carboxyl group and an acid value of 30 to 50 KOH mg/g.

As regards the molecular weight of the water-insoluble polymer which constitutes the self-dispersing polymer particles, a weight-average molecular weight of 3000 to 200,000 is desirable, 5000 to 150,000, more desirable, and 10,000 to 100,000, even more desirable. By having a weight-average molecular weight of not less than 3000, it is possible to restrict the amount of water-soluble component effectively. Furthermore, by having a weight-average molecular weight of not more than 200,000, it is possible to improve the self-dispersion stability.

The weight-average molecular weight is measured by gel permeation chromatography (GPC). The GPC is carried out using an HLC-8220 GPC device (made by TOSOH CORPORATION) and three columns, a TSK gel Super HZM-H, TSK gel Super HZ 4000 and TSK gel Super HZ2000 (made by TOSOH CORPORATION; 4.6 mm ID by 15 cm), with an eluent of THF (tetrahydrofuran). Furthermore, the chromatography conditions include: the sample density of 0.35/min, flow rate of 0.35 ml/min, sample inlet amount of 10 μl, and measurement temperature of 40° C., and an IR detector is used. Moreover, a calibration curve is created from eight samples manufactured by TOSOH CORPORATION: "standard sample TSK standard, polystyrene": "F-40", "F-20", "F-4", "F-1", "A-5000", "A-2500", "A-1000", "n-propyl benzene".

The average particle size of the self-dispersing polymer particles is desirably in the range of 10 nm to 400 nm, more desirably in the range of 10 to 200 nm, and even more desirably, in the range of 10 to 100 nm, as a volume-average particle size. If the volume-average particle size is not less than 10 nm, manufacturability is improved, and if the volume-average particle size is not more than 1 μm, then storage stability is improved.

The average particle size and the particle size distribution of the particles of self-dispersing polymer are determined by measuring the volume-average particle size by dynamic light scattering using a UPA-EX150 Nanotrac particle size distribution analyzer (measurement device) manufactured by NIKKISO CO., LTD.

The particles of self-dispersing polymer used may be of one type only or a combination of two or more types. The content of the self-dispersing polymer particles in the ink composition is desirably 1 to 30 percent by mass and more desirably 5 to 15 percent by mass with respect to the ink composition, from the viewpoint of the aggregation speed and the image luster, and so on.

Furthermore, the content ratio between the pigment and the self-dispersing polymer particles in the ink composition (for example, the ratio of water-insoluble pigment particles/self-dispersing polymer particles) is desirably 1/0.5 to 1/10 and more desirably 1/1 to 1/4, from the viewpoint of the wear resistance of the image, and the like.

Polymerizable Compound

The ink composition according to the present embodiment may include at least one type of water-soluble polymerizable compound which is polymerized by an active energy beam.

Water-soluble means that the compound can be dissolved to a prescribed density or above in water, and the compound should be dissolvable in an aqueous ink (and desirably in a uniform fashion). Furthermore, the compound may also be dissolved in the ink (desirably in a uniform fashion), by raising the solubility through the addition of a water-soluble organic solvent which is described hereinafter. More specifically, the solubility of the compound with respect to water is desirably not less than 10 percent by mass and more desirably, not less than 15 percent by mass.

From the viewpoint of avoiding obstacles to the reaction between the aggregating agent, the pigment and the polymer particles, the polymerizable compound is desirably a non-ionic or cationic polymerizable compound and desirably is a polymerizable compound having a solubility with respect to water of not less than 10 percent by mass (and more desirably, not less than 15 percent by mass).

From the viewpoint of raising resistance to wear, the polymerizable compound of the present mode is desirably a polyfunctional monomer, desirably a bifunctional to a hexafunctional monomer, and from the viewpoint of achieving both solubility and wear resistance, a bifunctional to a tetrafunctional monomer.

It is possible to include only one type or a combination of two or more types of polymerizable compound.

The content of the polymerizable compound in the ink composition is desirably 30 to 300 percent by mass and more desirably 50 to 200 percent by mass, with respect to the total solid content of the pigment plus the self-dispersing polymer particles. If the content of the polymerizable compound is not less than 30 percent by mass, then the image strength is improved and excellent wear resistance of the image is obtained, whereas if the content is not more than 300 percent by mass, then a benefit is obtained in terms of pile height.

Initiator

The ink composition according to the present embodiment may also contain at least one type of initiator which initiates polymerization of the polymerizable compound by an active energy beam, either in addition to the treatment liquid described below or in the absence of the treatment liquid described below. A photopolymerization initiator may be used, either one type only or a combination or two or more types, and may be used conjointly with a sensitizing agent.

The initiator may include a suitably selected compound which is capable of starting a polymerization reaction by application of an active energy beam; for example, it is possible to use an initiator (for example, a photopolymerization initiator or the like) which creates an active species (radical, acid, base, or the like) upon application of a beam of radiation, light or an electron beam.

If an initiator is included, then the content of the initiator with respect to the ink composition is desirably 1 to 40 percent by mass, and more desirably, 5 to 30 percent by mass, with respect to the polymerizable compound. If the content of the initiator is not less than 1 percent by mass, then the wear resistance of the image is further improved, which is beneficial in the case of high-speed recording, and if the content of the initiator is not more than 40 percent by mass, then a benefit in terms of ejection stability is obtained.

Water-Soluble Organic Solvent

The ink composition according to the present embodiment may include at least one type of water-soluble organic solvent. A water-soluble organic solvent can bring about beneficial effects in preventing drying, moistening or promoting permeation. In order to prevent drying, the solvent is used as an anti-drying agent which prevents blockages caused by ink adhering to the ink ejection ports of the ejection nozzles and drying to form aggregate material, and in order to prevent drying and achieve moistening, a water-soluble organic solvent having a lower vapor pressure than water is desirable. Furthermore, in order to promote permeation, it can be used as a permeation promoter which raises the permeability of the ink into the paper.

A water-soluble organic solvent having a lower vapor pressure than water is desirable as an anti-drying agent.

It is possible to use only one type or a combination of two or more types of anti-drying agent. The content of the anti-drying agent is desirably in the range of 10 to 50 percent by mass in the ink composition.

A water-soluble organic solvent is suitable as a permeation promoter with the object of causing the ink composition to permeate more readily into the recording medium (printing paper, or the like). It is possible to use only one type or a combination of two or more types of permeation promoter. The content of the permeation promoter is desirably in the range of 5 to 30 percent by mass in the ink composition. Furthermore, the permeation promoter is desirably used in a weight range that does not cause image bleeding or print through.

Water

The ink composition includes water, but there are no particular restrictions on the amount of water. However, a desirable content of water is 10 to 99 percent by mass, more desirably, 30 to 80 percent by mass, and even more desirably, 50 to 70 percent by mass.

Other Additives

The ink composition of the present mode can be composed by using other additives apart from the components described above. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, an antifungal agent, a pH adjuster, a surface tension adjuster, an antifoaming agent, a viscosity adjuster, a dispersant, a dispersion stabilizer, an anti-rusting agent, a chelating agent, and the like.

Treatment Liquid

The treatment liquid includes at least an aggregating agent which aggregates the components in the ink composition described above, and may also be composed by using other components according to requirements. By using a treatment liquid in addition to an ink composition, it is possible to raise the speed of inkjet recording, and an image having excellent definition (reproducibility of fine lines and intricate detail portions) with good density and high resolution is obtained even during high-speed recording. Furthermore, by improving the preparation of the treatment liquid and the ink composition, it is possible to raise the strength of the actual image formed, and hence the durability of the image with respect to high-pressure air blowing, and the like, can be enhanced.

The aggregating agent used may be a compound capable of changing the pH of the ink composition, or a polyvalent metal salt, or a polyallyl amine. In the present mode, from the viewpoint of the aggregating properties of the ink composition, a compound capable of changing the pH of the ink composition is desirable, and a compound capable of lowering the pH of the ink composition is more desirable.

In the present mode, it is desirable to choose an aggregating agent that is capable of rapidly separating the solid component from the carrying component (the liquid component) after aggregation, or making the aggregate material itself more rigid. For an aggregating agent of this kind, an organic acid is desirable, a bifunctional or higher organic acid is desirable, and a bifunctional or higher and trifunctional or lower acid material is especially desirable. As a bifunctional or higher organic acid, an organic acid having a first pKa value of not more than 3.5 is desirably, and an organic acid having a first pKa value of not more than 3.0 is more desirable. More specifically, suitable examples of this acid are: phosphoric acid, oxalic acid, malonic acid, citric acid, and the like.

It is possible to use only one type, or to combine two or more types, of aggregating agent.

The content ratio of the aggregating agent which aggregates the ink composition in the treatment liquid is desirably, 1 to 50 percent by mass, more desirably, 3 to 45 percent by mass and even more desirably 5 to 40 percent by mass.

The treatment liquid may include other additives as further components, provided that this does not impair the beneficial effects of the present mode. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, an antifungal agent, a pH adjuster, a surface tension adjuster, an antifoaming agent, a viscosity adjuster, a dispersant, a dispersion stabilizer, an anti-rusting agent, a chelating agent, and the like.

Recording Medium

The inkjet recording method according to the present mode records an image on a recording medium.

There are no particular restrictions on the recording medium, but it is possible to use general printing papers that are used in normal offset printing, or the like, and whose main component is cellulose, such as so-called high-grade paper, coated paper, art paper, or the like. General printing papers having cellulose as a main component display relatively slow ink absorption and drying in image recording using a standard inkjet method which employs aqueous ink, movement of the coloring material is liable to occur after droplet ejection, and image quality is liable to decline. However, if the inkjet recording method according to the present mode is employed, then movement of the coloring material is suppressed and high-quality image recording having excellent color density and color hues can be achieved.

Of recording media, so-called coated paper which is used in general offset printing, and the like is desirable. Coated paper is generally high-quality paper or neutralized paper which is principally made of cellulose and which does not generally have a surface treatment, on which a coating layer has been provided on the surface thereof by applying a coating material. Coated paper is liable to produce problems of image quality, such as the image luster and wear resistance, and the like, in image formation using a standard aqueous inkjet method, but in the image recording method according to the present mode, non-uniformities in luster are suppressed and it is possible to obtain an image having good luster and wear resistance. In particular, it is desirable to use a coated paper having a base paper and a coating layer including an inorganic pigment, and it is more desirable to use a coated paper having a base paper and a coating layer including kaolin and/or calcium bicarbonate. More specifically, art paper, coated paper, lightweight coated paper or fine coated paper are more desirable.

In the present mode, desirably the pressing force of the non-contact-type recording medium restricting device is controlled in accordance with the rigidity of the recording medium. The rigidity of the recording medium can be judged from the basis weight, for instance, and with a recording medium having a basis weight of not more than 127.9 gsm, the pressure created by the non-contact-type recording medium restricting device is lowered, whereas with a recording medium having a basis weight higher than 230 gsm, the pressure is raised, thereby making it possible to control floating up of the trailing end of the recording medium. It is also possible to control the pressure in a stepwise fashion, in accordance with the basis weight.

PRACTICAL EXAMPLES

The present mode is described in more specific terms below with reference to practical examples, but the present mode is not limited to these examples.

Experimental Example 1 of First Mode

Restriction of Rear End of Thick Paper and Image Damage

Treatment liquid (containing malonic acid) was applied to a recording medium, namely, paper of half-Kiku size (636×469 mm, paper called Ibest W, basis weight: 310 gsm (made by Nippon Paper Industries Co., Ltd.)), a solid image was formed thereon by an inkjet method (average ink droplet ejection volume of 5 pl), and the paper was dried on a suction drying drum, whereupon the floating up of the trailing end of the recording medium and the damage to the image were evaluated on the basis of the following criteria.

(1) Floating up of Trailing End: Degree of Suppression of Floating up of Trailing End by Non-Contact-Type Recording Medium Restricting Device <Evaluation>

The state of tight adherence of the trailing end of the recording medium to the suction drum was observed visually.

○: Medium suctioned correctly up to and including trailing end.

Δ: Slight floating up of trailing end, but tolerable.

x: Trailing end floats up completely and failure of suctioning.

(2) Image Damage: Degree of Damage Caused to Image by Non-Contact-Type Recording Medium Restricting Device.

<Evaluation>

The extent of density non-uniformities and appearance of the paper base due to flowing of ink in the whole of the solid image area of the sample was observed visually.

○○: No damage to image at all.

○: Some areas of image show slight density non-uniformity, but tolerable.

Δ: Density non-uniformities in image.

x: Image has flowed and paper surface is partially exposed.

xx: Whole of image has flowed and the image is not visible.

TABLE 1-1

| | Deposition of treatment liquid | Air flow velocity [m/s] | Floating up of trailing end | Image damage |
|---|---|---|---|---|
| Comparative Example 1 | Yes | 10 | x | ○○ |
| Practical Example 1 | Yes | 25 | Δ | ○○ |
| Practical Example 2 | Yes | 40 | ○ | ○○ |
| Practical Example 3 | Yes | 55 | ○ | ○ |
| Comparative Example 2 | Yes | 70 | ○ | Δ |
| Comparative Example 3 | No | 10 | x | Δ |
| Comparative Example 4 | No | 40 | ○ | x |

○○: No damage to image at all.
○: Some areas of image show slight density non-uniformity, but tolerable.
Δ: Density non-uniformities in image.
x: Image has flowed and paper surface is paartially exposed.
xx: Whole of image has flowed and the image is not visible.

Experimental Example 2 of First Mode

Density Non-Uniformity in Suction Area of Thin Paper

Image formation and drying were carried out using the same method as that of Experimental Example 1, with the exception that OK Top (basis weight 73.3 gsm, made by Oji paper Co., Ltd.) was used as the recording medium, and the air flow velocity was set to 10 (m/s). Density non-uniformities were subsequently evaluated on the basis of the following criteria.

<Evaluation>

The density difference between the portions corresponding to the suction holes and the portions apart from the suction holes in the solid image area of the sample was observed with an optical microscope.

○: No density difference observed.

x: Density difference observed.

TABLE 1-2

| | Deposition of treatment liquid | Density non-uniformities |
|---|---|---|
| Practical Example 4 | Yes | ○ |
| Comparative Example 5 | No | x |

○: No density difference observed.
x: Density difference observed.

Experimental Example 3 of First Mode

Control of Air Velocity (Air Volume)

Image formation and drying were carried out using the same method as that of Experimental Example 1, with the exception that the average ink droplet ejection volume was 7.5 pl and the air flow velocity from the air blowing nozzles was set to the velocities shown in Table 1-3 and Table 1-4. Evaluation was then made subsequently based on the same criteria as Experimental Example 1.

Figure 8:
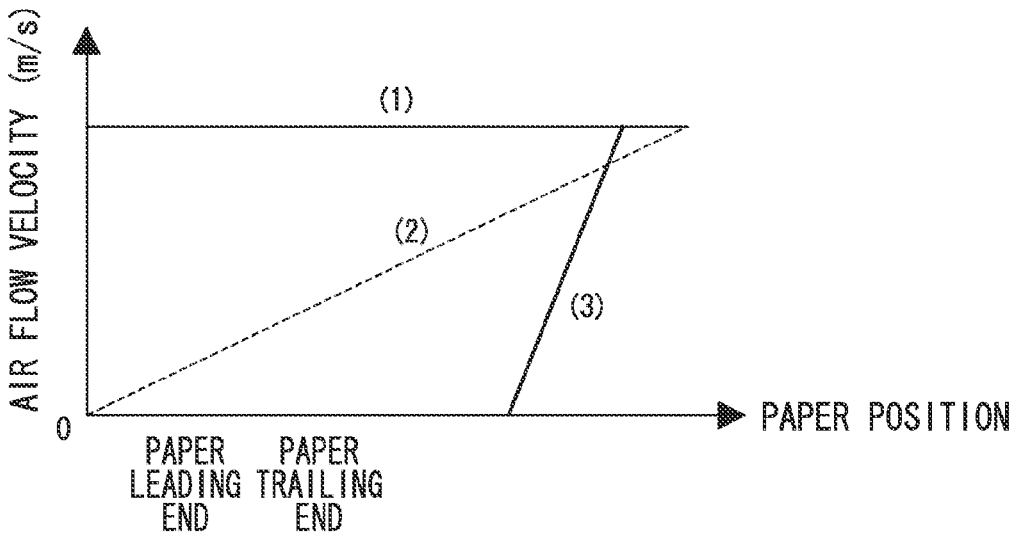
FIG. 8 is a diagram for describing the setting of wind velocity in Experimental Example 3 of the first mode.

The air flow velocity settings shown in Table 1-4 were made by altering the air flow velocity from the leading end toward the trailing end of the recording medium, as shown in FIG. 8.

TABLE 1-3

| | Deposition of treatment liquid | Air flow velocity [m/s] | Floating up of trailing end | Image damage |
|---|---|---|---|---|
| Comparative Example 6 | Yes | 10 | x | ○ |
| Comparative Example 7 | Yes | 40 | ○ | Δ |
| Comparative Example 8 | No | 10 | x | x |
| Comparative Example 9 | No | 40 | ○ | xx |

TABLE 1-4

| | Deposition of treatment liquid | Air flow velocity setting | Floating up of trailing end | Image damage |
|---|---|---|---|---|
| Comparative Example 10 | Yes | (1) in FIG. 8 | ○ | Δ |
| Practical Example 5 | Yes | (2) in FIG. 8 | ○ | ○ |
| Practical Example 6 | Yes | (3) in FIG. 8 | ○ | ○ |

Experimental Example 4 of First Mode

Effect of Aggregating Agent

Image formation and drying were carried out using the same method as that of Experimental Example 1, with the exception that the aggregating agents shown in Table 1-5 as the type of aggregating agent included in the treatment liquid. The treatment liquid was made by adding the same weight (same mass) of the respective aggregating agents.

TABLE 1-5

| | Aggregating agent | Air flow velocity [m/s] | Floating up of trailing end | Image damage |
|---|---|---|---|---|
| Practical Example 7 | Organic acid (Malonic acid) | 40 | ○ | ○○ |
| Practical Example 8 | Cationic polymer (Polyallyl amine) | 40 | ○ | ○- |
| Practical Example 9 | Polyvalent metal (Magnesium nitrate) | 40 | ○ | ○- |

Second Mode

Next, a second mode of the present invention will be described.

Desirable embodiments of a recording medium conveyance apparatus and a recording medium conveyance method relating to the present mode are described below with reference to the accompanying drawings. In the embodiments described below, an inkjet recording apparatus is given as one example of a recording medium conveyance apparatus, but the present mode is not limited to this and it is also possible to use any other apparatus which conveys a recording medium on curved surfaces. Furthermore, conveyance on a curved surface is not limited to drum conveyance, and the present mode can also be used in the case of belt conveyance, or the like.

General Composition of Inkjet Recording Apparatus

Firstly, the general composition of an inkjet recording apparatus to which the recording medium conveyance apparatus and the recording medium conveyance method of the present embodiment is applied will be described.

Since the inkjet recording apparatus according to the present embodiment has common parts to the above-described configuration of the first mode illustrated in FIGS. 1-7, then description of such common parts of the inkjet recording apparatus according to the present embodiment is omitted below.

First Embodiment of Second Mode

In the present embodiment, the air blowing nozzle 83 is provided as a non-contact-type recording medium restricting device in order to cause the recording medium 22 to be held stably in tight contact with the drying drum 76 which has curvature. For the non-contact-type recording medium restricting device, it is possible to use an air blowing device such as the air blowing nozzle 83 shown in FIG. 1, or the like. Furthermore, it is also possible to use a known air blowing device, such as a blower, fan, or the like, as the air blowing device. By using a non-contact-type recording medium restricting device, it is possible to cause the recording medium to adhere tightly to the drying drum 76 in a state where slackness and floating up of the recording medium have been corrected, and suctioning can be performed in a uniform fashion.

In the present embodiment, the pressing position by the air blowing nozzles 83 and the suctioning start position by the suctioning device are controlled in accordance with the rigidity of the recording medium. The lower the rigidity of the recording medium, the more desirable it becomes to set the suctioning start position to the downstream side with respect to the pressing position, in terms of the conveyance direction. Since the recording medium 22 is pressed by the non-contact-type recording medium restricting device and is suctioned after wrinkles have been adequately suppressed, then it is possible to suppress wrinkles that occur in the recording medium 22. Furthermore, if the recording medium has high rigidity, then it is desirable that the suctioning start position should be to the upstream side with respect to the pressing position in terms of the conveyance direction, or at the same position as the pressing position. If the recording medium has high rigidity, then there is a point in regard to whether the recording medium 22 can be conveyed in a state of tight adherence to the drying drum 76 without floating up from the drum. By pressing the medium by the air blowing nozzles 83 and performing suctioning by the suctioning device, it is possible to cause the recording medium 22 to adhere tightly to the drying drum 76 without floating up from the drum. If the suctioning start position is at the same position as, or to the upstream side of, the pressing position of the air blowing nozzles 83, then it is possible to shorten the distance between the recording medium 22 and the drying drum 76 (suctioning surface) by the pressure created by the air blowing nozzles 83, and therefore suctioning can be performed by the suctioning device. Conversely, if the suctioning start position is to the downstream side of the pressing position, then the recording medium 22 does not lie along the curved surface of the drying drum 76, and therefore the recording medium 22 may float up from the drying drum 76 and the number of suction holes that are not closed off may increase. In this case, the suction force declines and there is a concern that the trailing end of the recording medium 22 may bounce back up again after passing the air blowing position. Suctioning is therefore performed by starting suctioning of the whole suctioning surface at the time when the recording medium 22 passes the suction start position.

FIG. 2 shows an enlarged diagram of a recording medium conveyance apparatus (drying unit) relating to a first embodiment of the second mode. In FIG. 2, desirably, the suctioning start position is set in the range indicated by the arrow on the outer circumference of the drying drum 76. Moreover, desirably, the positional relationship between the pressing position and the suctioning start position is controlled in accordance with the diameter of the drum, and the size of the recording medium. If the recording medium has low rigidity, then it is desirable that the larger the size of the recording medium, suctioning is started further to the downstream side in terms of the conveyance direction. This is because it is possible to prevent the recording medium from being suctioned in a state where wrinkles have not been satisfactorily suppressed by means of the non-contact-type recording medium restricting device in the trailing half of the recording medium.

If the position of the non-contact-type recording medium restricting device is fixed, then the suctioning start position can be controlled with respect to the pressing position by controlling the timing at which suctioning is started by the suctioning device of the drying drum 76. Furthermore, if the suction timing is fixed, then the suctioning start position can be controlled by arranging the air blowing nozzle 83 so as to be movable in the conveyance direction.

The timing of the start of pressing of the recording medium by the non-contact-type recording medium restricting device is desirably the same time as, or before, the time at which the leading end of the recording medium passes the pressing position. Furthermore, the end timing is desirably after the trailing end portion of the recording medium has passed the pressing position.

Desirably, the pressing force (air flow pressure) of the non-contact-type recording medium restricting device is controlled in accordance with the rigidity of the recording medium. It is possible to avoid damage to the image by a strong air flow, by controlling the pressing force. Furthermore, it is also possible to adjust the pressing force (air flow pressure) of the non-contact-type recording medium restricting device in accordance with the position of the recording medium. For example, it is possible to increase the pressing force (air flow pressure) toward the trailing end of the recording medium in the conveyance direction, or to perform intermittent air blowing in which pressing (blowing of an air flow) is performed only when the trailing end of the recording medium is passing, and the region apart from the trailing end is a region where air blowing is not performed. In particular, if a recording medium having high rigidity is used and the air flow orientation produced by the air blowing device is directed from the downstream side to the upstream side in terms of the direction of conveyance of the recording medium, as described below, then there is little need for particular concern about the occurrence of wrinkles and furthermore the recording medium 22 can be made to lie over the surface of the conveyance body of the drying drum 76 by the air flow. Therefore, it is possible to achieve stable conveyance of the recording medium, by causing the recording medium to adhere tightly to the drying drum 76 by performing air blowing during the passage of the trailing end of the recording medium. Furthermore, by adjusting the air flow pressure of the air blowing device in this way, it is possible to minimize and optimize the air blowing range.

Desirably, the air flow velocity produced by the air blowing device is in the range of 5 to 200 (m/s). If the air flow velocity is lower than 5 (m/s), then the effect in suppressing wrinkles is insufficient, and if the air flow velocity is greater than 200 (m/s), then in cases where the ink deposition volume is large in the image portion and in a state where the ink has not yet dried, there is a concern that the image can be damaged by the blown air flow. It is possible to blow air onto an image in a dried state without any particular restrictions. The air flow velocity is measured by measuring the flow speed V (m/s) at a distance equivalent to the gap from the air flow outlet of the air blowing device (the air nozzle outlet port, or the like) to the surface of the recording medium. The air flow velocity can be measured using an Anemomaster Model 6004 (anemometer) manufactured by Kanomax group, for example.

The air flow volume required in the air blowing device varies with the width and thickness of the recording medium, but desirably, is in the range of 0.1 to 2 ($m^3$/min) for a recording medium of half Kiku size (636 mm×469 mm), for example. The air flow volume is calculated by the following equation from the measurement value of the air flow velocity. The air flow velocity (air flow volume) can be adjusted by regulating the pressure by means of a regulator in the case of compressed air, or by controlling the blower input power in the case of a blower device.

$$Q = V \times A \times 60 (m^3/\text{min})$$

(Q: air flow volume ($m^3$/min), V: air flow velocity (m/s), and A: air flowing surface area ($m^2$))

The non-contact-type restricting device is able to perform air blowing by joining together air blowing nozzles 83 as shown in FIGS. 3A and 3B, for example, (nozzle width: 50 mm per nozzle), in the width direction of the recording medium, but there are no particular restrictions on the shape and material of the members used, provided that a desired air flow velocity (air flow volume) is obtained. However, with regard to the material, a heat-resistant material is desirable if the non-contact-type recording medium restricting device is to be to provided in the vicinity of the drying device, or is to serve also as a drying device as described hereinafter.

FIG. 3B is a diagram showing the shape of nozzle opening sections 83*a*. FIG. 3B is a diagram of a case where a plurality of fine round holes (nozzle diameter: 1.2 mm) are arranged as the opening sections 83*a*; however, there are no particular restrictions on the shape and size thereof, and it is also possible to increase the nozzle diameter of the opening sections 83*a* in order to blow air over a broader region, and the shape is not limited to a round shape and may also be a square shape.

The distribution of the air flow velocity (air flow volume) can also be changed by means of the individual nozzles. For example, the air flow velocity can be increased in the image area so as to suppress floating up, and can be reduced in the non-image area. Furthermore, if the size of the recording medium varies, then it is possible to perform air blowing only in the portion corresponding to the length in the width direction of the recording medium. By supplying an air flow to the region of the side face portion of the conveyance body where the recording medium does not pass, it is possible to prevent the air flow from entering into the rear surface of the recording medium and giving rise to floating up or disorderly conveyance of the recording medium.

FIG. 4 is a plan diagram showing orientations and arrangements of individual nozzles 83. An air flow is sprayed out toward the recording medium 22. (a) of FIG. 4 is a normal nozzle arrangement without any rotation of the nozzles. The individual nozzles 83 can be rotatable, and can be rotated so as to be inclined from the center toward either end portion of the recording medium, as shown in (b) of FIG. 4, for example, or from one end portion toward the other end portion as shown in (c) of FIG. 4. By adopting the arrangement shown in (b) or (c) of FIG. 4, it is possible to disperse wrinkles toward the end portions in the width direction of the recording medium, or to expel wrinkles to the end portions in the width direction.

Furthermore, the individual nozzles do not have to be arranged in the same row in the width direction of the recording medium, and may also be arranged in such a manner that an air flow is blown successively from the center toward either end portion of the recording medium, as shown in (d) of FIG. 4, or from one end portion toward the other end portion, as shown in (e) of FIG. 4. By adopting an arrangement of this kind, it is possible further to enhance the effect of dispersing wrinkles toward the end portions in the width direction of the recording medium or expelling wrinkles to the end portions in the width direction.

(a) to (e) of FIG. 4 show a mode including a plurality of nozzles 83, but as shown in (f) of FIG. 4, it is also possible to use a nozzle 83 having an opening section of a length equal to the length of the width direction of the recording medium 22. By using one nozzle, the air flow velocity (air flow volume) is standardized (equalized), and it is possible to avoid local concentration of wrinkles, for example.

As shown in FIG. 2, desirably, the orientation of the air flow from the air blowing nozzles 83 is arranged in such a manner that an air flow is blown in an oblique direction from the leading end side toward the trailing end side of the recording medium 22 in terms of the conveyance direction. By this means, it is possible to cause the recording medium 22 to lie along the drying drum 76 and enhance the pressing effect created by the air flow. The air blowing direction is desirably set in such a manner that the angle θ formed between the air blowing direction and the normal to the point at which the air flow makes contact with the recording medium 22 (drying drum 76) is not less than 0° and not more than 75°. If the inclination exceeds the aforementioned range, then the pressing effect is insufficient and therefore such a case is not desirable.

Furthermore, it is also possible to adopt a composition in which the angle θ of the air blowing nozzles 83 can be adjusted. For example, if the recording medium has low rigidity, then aligning the paper with the surface of the conveyance body is prioritized and the angle θ can be made large, whereas if the recording medium has high rigidity, then causing the recording medium to adhere tightly to the surface of the conveyance body is prioritized, and the angle θ can be made small. Furthermore, as shown below, if the non-contact-type recording medium restricting device is constituted by a plurality of air blowing nozzles 83, and the like, then it is possible to adopt a composition where the angle θ can be controlled respectively in each of the air blowing nozzles 83.

Furthermore, the non-contact-type recording medium restricting device may also be combined with a drying device (i.e. the non-contact-type recording medium restricting device may also serve as a drying device). If a drying fan with a built-in heater which blows a hot air flow onto the recording medium from air nozzles is used as the non-contact-type recording medium restricting device, then it is possible to carry out drying. In a drying unit where drying fans are arranged in a plurality of rows in the conveyance direction, the drying conditions can be set by raising the air flow volume of the drying fans in a first row, or increasing the air flow velocity by restricting the openings of the air nozzles, or inclining the air spraying angle toward the upstream side of the direction of conveyance.

Figure 9:
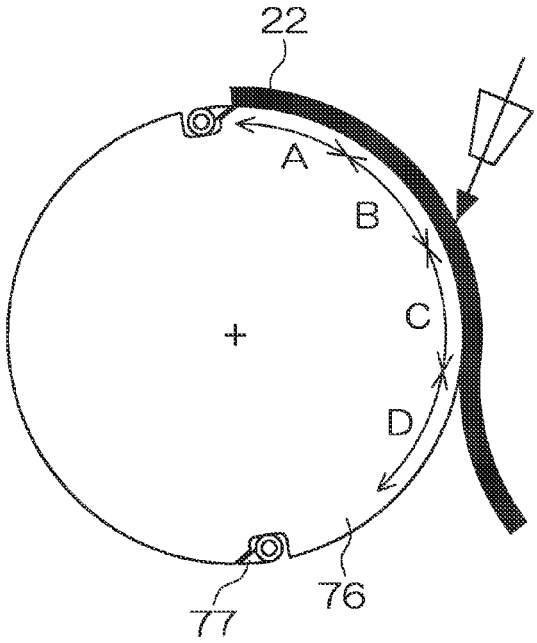
FIG. 9 is an enlarged diagram showing a modification example of a recording medium conveyance apparatus relating to the first embodiment of the second mode.

Suctioning can be performed in a stepwise fashion from the downstream side of the direction of conveyance (the leading end side of the recording medium). For example, the suctioning region is divided into a plurality of regions, as shown in FIG. 9 (in FIG. 9, four regions A, B, C and D), and the on/off switching and suctioning force in each region can be controlled. In FIG. 9, suctioning is started in the regions A and B where the air blowing position has been passed and suctioning is not started in regions C and D. By performing suctioning in a stepwise fashion, the region of the recording medium that has just passed the non-contact-type recording medium restricting device and which has been corrected in terms of wrinkles and floating up, can be suctioned straight away, and therefore the recording medium can be suctioned uniformly in a more reliable fashion. Moreover, in cases where the suctioning of the whole suction region of the suctioned surface can only be performed simultaneously and the recording medium has a large size, there is a concern that in the leading end portion of the recording medium, time will have passed since the correction by the non-contact-type recording medium restricting device and wrinkles and floating up may have occurred again, while in the trailing end portion of the recording medium, the recording medium is suctioned to the conveyance body without wrinkles and floating having been corrected. However, by performing suctioning in a stepwise fashion, it is possible to suction the recording medium onto the conveyance body in a more desirable state, and therefore stable conveyance can be achieved.

Desirably, the air flow blown from the air flow blowing device is heated. By blowing a heated air flow, it is possible to speed up the drying of the recording medium 22, and therefore if the recording medium has low rigidity, it is possible to suppress the occurrence of cockling in the recording medium 22.

Desirably, the air blowing device is divided into a plurality of sections in the width direction of the recording medium 22, and the pressing force (air flow pressure) of each section can be controlled respectively. Similarly, it is desirable that the suctioning device should be divided into a plurality of sections in the width direction of the recording medium 22. By controlling the pressing force produced by the air blowing device and the suctioning force produced by the suctioning device, in accordance with the image data, it is possible to enhance the effect in suppressing wrinkles in locations where the droplet ejection volume is high. Furthermore, it is also desirable to increase the pressing force of each of the air blowing devices and the suctioning force of the respective suctioning devices in sections in the central portion of the width direction of the recording medium 22. Wrinkles are liable to occur in the central portion of the recording medium 22, and therefore by increasing the pressing force and the suctioning force in the central portion of the width direction of the recording medium 22, it is possible to suppress wrinkles in the central portion and hence to prevent wrinkles in the whole of the recording medium.

As described above, by making the suctioning device controllable in terms of the conveyance direction of the recording medium and making the air blowing device and the suctioning device controllable in terms of the width direction of the recording medium, it is possible to achieve optimal control in accordance with the image data, by combined control of the devices.

Second Embodiment of Second Mode

FIG. 5 is a schematic drawing of a recording medium conveyance apparatus according to a second embodiment of the invention. The recording medium conveyance apparatus according to the second embodiment differs from that of the first embodiment in that an air blowing nozzle (non-contact-type recording medium restricting device) 283 is provided inside the intermediate conveyance body (transfer drum) 30 which is connected before the drying drum 76.

By providing the air blowing nozzle 283 inside the intermediate conveyance body 30, it is possible reduce the space occupied by the whole inkjet recording apparatus 1. Furthermore, by providing a non-contact-type recording medium restricting device inside the intermediate conveyance body 30, in the case of thin paper, it is possible to press the paper in a position further upstream from the point where the paper is received onto the drying drum 76, and therefore it is possible to start suctioning to the upstream side of the drying drum 76. Consequently, the heating efficiency from the rear surface can be improved on the drying drum 76. Furthermore, if it is implemented on the image formation drum 70, it is possible to reduce the effects of disorderly behavior of the trailing end of the recording medium.

Figure 10:
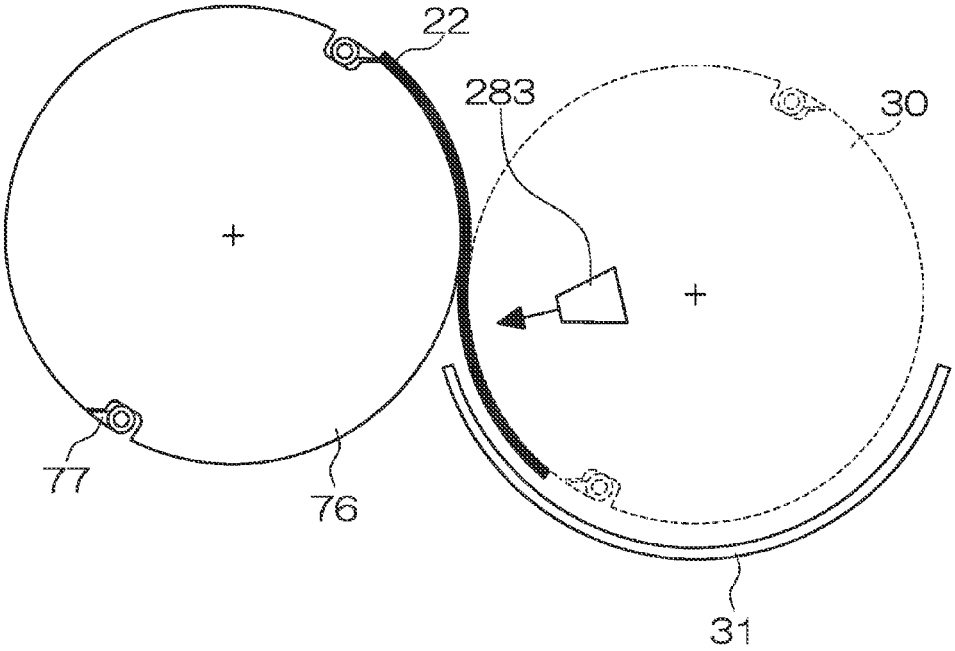
FIG. 10 is an enlarged diagram showing a modification example of a recording medium conveyance apparatus relating to the second embodiment of the second mode.

FIG. 10 is a plan view perspective diagram showing a modification example of the recording medium conveyance apparatus relating to the second embodiment of the second mode. A difference in FIG. 10 is that a transfer drum guide 31 is provided to guide the recording medium conveyed on the intermediate conveyance unit. By providing the transfer drum guide 31, it is possible to prevent the recording medium from adhering the drying drum 76 before being pressed by the air blowing device, even if suctioning is performed simultaneously. Furthermore, since suctioning is carried out successively from the portion which is situated at a close distance to the suctioning surface, due to the conveyance of the medium, then it is possible to suppress the occurrence of wrinkles. The present embodiment can be used to particularly beneficial effect in a recording medium having low rigidity.

Since the transfer drum guide 31 can be provided also when the recording medium 22 is conveyed by the intermediate conveyance unit 30, then it can also be used when air blowing nozzles 83 are provided on the outer circumferential surface of the drying drum 76, as in the first embodiment of the second mode.

The pressing force of the air flow (air flow pressure) and the air blowing direction produced by the air blowing device can be attained in a similar fashion to the first embodiment.

Third Embodiment of Second Mode

FIG. 6 is a plan view perspective diagram of a recording medium conveyance apparatus relating to a third embodiment of the second mode. The recording medium conveyance apparatus according to the third embodiment differs from those of the first embodiment and the second embodiment in that the non-contact-type recording medium restricting device is constituted by a first non-contact-type recording medium restricting device 283 which is provided inside the intermediate conveyance body 30 and a second non-contact-type recording medium restricting device 83 which is provided on the outer circumferential surface of the drying drum 76.

By providing two non-contact-type recording medium restricting devices—air blowing nozzles (a first non-contact-type recording medium restricting device) 283 and air blowing nozzles (a second non-contact-type recording medium restricting device) 83—in two locations respectively as described in the third embodiment, it is possible to cause the recording medium 22 to adhere tightly to the drying drum 76 in a more reliable fashion and therefore stable conveyance can be achieved.

In the recording medium conveyance apparatus relating to the third embodiment, the pressing force of the air flow (air flow pressure) and the air blowing direction produced by the air blowing nozzles can be achieved by a similar method to that of the first embodiment and the second embodiment.

Furthermore, in the third embodiment, the air blowing position is the position where the recording medium 22 is pressed by the second non-contact-type recording medium restricting device 83.

The drying unit of an inkjet recording apparatus has been described as one example of a recording medium conveyance apparatus, but the present invention is not limited to this and can also be applied to other cases where it is necessary to suction a recording medium on a curved conveyance body without the occurrence of wrinkles or floating up. For example, in other parts of an inkjet recording apparatus, the present invention can also be used to improve the passage of paper by preventing wrinkles and floating up of a recording medium on an image formation drum, or to suppress wrinkles in the fixing nip of heat rollers by preventing floating up of the recording medium on a fixing drum. Pressing by means of the non-contact-type recording medium restricting device according to the present embodiment has especially beneficial effects in the drying unit, since an image has been formed on the recording medium by the image formation unit 14 and it is difficult to use a roller-based pressing device.

Fourth Embodiment of Second Mode

Figure 11:
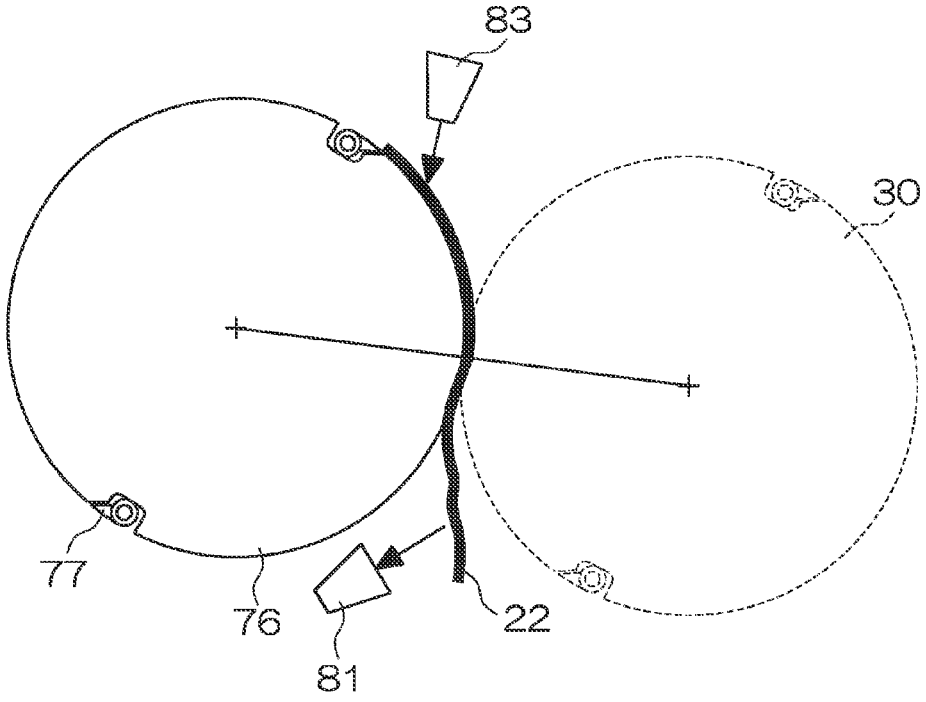
FIG. 11 is an enlarged diagram of a recording medium conveyance apparatus relating to a fourth embodiment of the second mode.

FIG. 11 is a plan view perspective diagram of a recording medium conveyance apparatus relating to a fourth embodiment of the second mode. The recording medium conveyance apparatus according to the fourth embodiment differs from the other embodiments in that, apart from the suctioning device provided in the drying drum 76, an auxiliary suctioning device 81 is provided on the upstream side with respect to the air blowing nozzles 83. The auxiliary suctioning device 81 is disposed so as to perform the suction from the rear surface side of the recording medium 22 (the drying drum 76 side). By providing the auxiliary suctioning device 81, it is possible to cause the recording medium to wrap more reliably about the drying drum 76 and adhere tightly thereto.

In the fourth embodiment, if a recording medium having low rigidity is used, then there is a possibility that the trailing end portion of the recording medium is suctioned before having passed the air blowing position, and wrinkles or floating may occur; therefore, it is desirable to use a recording medium having high rigidity, in particular.

Exposure Curing Unit

The exposure curing unit 18 includes a UV lamp 88 and an in-line sensor 90. The UV lamp 88 and the in-line sensor 90 are disposed at positions opposing the circumferential surface of an exposure curing drum 84, and are arranged in sequence from the upstream side of the direction of rotation of the exposure curing drum 84.

The exposure curing drum 84 is a drum which holds the recording medium 22 on the outer circumferential surface thereof and conveys the medium by rotation, and this drum is driven so as to rotate. Furthermore, the exposure curing drum 84 includes a hook-shaped holding device 85 provided on the outer circumferential surface of the drum, in such a manner that the leading end of the recording medium 22 can be held by the holding device 85. The recording medium 22 is conveyed by rotation due to the exposure curing drum 84 rotating in a state where the leading end is held by the holding device 85. In this step, the recording medium 22 is conveyed with the recording surface thereof facing toward the outside, and the recording surface is subjected to an exposure curing process by the UV lamp 88 and inspection by the in-line sensor 90.

The UV lamp 88 radiates UV light onto the dried ink so as to cure an active light-curable resin contained in the ink, thereby creating a film of the ink For the UV lamp 88, it is possible to use various ultraviolet sources, such as a metal halide lamp, a high-voltage mercury lamp, a black light, a cold cathode tub, a UV-LED, and the like.

The peak wavelength of the ultraviolet light irradiated by the ultraviolet light source 88 depends on the absorption characteristics of the ink composition, but is desirably 200 to 600 nm, more desirably, 300 to 450 nm, and even more desirably, 350 to 450 nm.

The irradiation energy of the ultraviolet light source 88 is desirably not more than 2000 mJ/cm$^2$, more desirably, 10 to 2000 mJ/cm$^2$, and even more desirably, 20 to 1000 mJ/cm$^2$, and especially desirably, 50 to 800 mJ/cm$^2$.

Furthermore, in the inkjet recording apparatus according to the present embodiment, the ultraviolet light is irradiated onto the recording surface of the recording medium for, desirably, 0.01 to 10 seconds, and more desirably, 0.1 to 2 seconds.

Moreover, the exposure curing drum 84 may be controlled to a prescribed temperature. By this means, the curing sensitivity of the ink can be raised, and the ink can be cured suitably and made into a film at low irradiation intensity.

On the other hand, the in-line sensor 90 is a measurement device for measuring a test pattern (pattern for checking), the amount of moisture, the surface temperature, the glossiness, and the like, with respect to the image fixed on the recording medium 22; and a CCD line sensor, or the like, is employed for the in-line sensor 90.

Output Unit

As shown in FIG. 1, an output unit 20 is provided subsequently to the fixing process unit 18. The output unit 20 includes an output tray 92, and a transfer drum 94, a conveyance belt 96 and a tensioning roller 98 are provided between the output tray 92 and the fixing drum 84 of the fixing unit 18 so as to oppose same. The recording medium 22 is sent to the conveyance belt 96 by the transfer drum 94 and output to the output tray 92.

Intermediate Conveyance Unit

Next, the structure of the first intermediate conveyance unit 24 will be described. The second intermediate conveyance unit 26 and the third intermediate conveyance unit 28 have a similar composition to the first intermediate conveyance unit 24, and description thereof is omitted here.

The first intermediate conveyance unit 24 has the intermediate conveyance body 30. The intermediate conveyance body 30 is a drum for receiving a recording medium 22 from a drum of the preceding stage, conveying the recording medium by rotation, and then transferring the recording medium onto a drum of the subsequent stage. This drum is installed rotatably. Furthermore, the intermediate conveyance body 30 is composed so as to rotate by means of a motor, which is not illustrated.

Hook-shaped holding devices are provided at 90° intervals on the outer circumferential surface of the intermediate conveyance body 30. The holding devices rotate while tracing a circular path, and the leading end of a recording medium 22 is held by the operation of a holding device. Consequently, it is possible to convey the recording medium 22 in rotation by rotating the intermediate conveyance body 30 in a state where the leading end of the recording medium 22 is held by the holding device. Desirably, a plurality of air blowing ports are provided in the surface of the intermediate conveyance body 30, and the recording medium is conveyed with the recording surface of the recording medium being in a non-contact fashion by blowing air out from these air blowing ports.

The recording medium 22 which has been conveyed by the first intermediate conveyance unit 24 is transferred to the drum of the subsequent stage (in other words, the image formation drum 70). In this step, the recording medium 22 is transferred by synchronizing a holding device of the intermediate conveyance unit 24 and a holding device on the image formation unit 14. The recording medium 22 that has been transferred is held and conveyed in rotation by the image formation drum 70.

Description of Control System

FIG. 7 is a principal block diagram showing a system composition of the inkjet recording apparatus 1. The inkjet recording apparatus 1 includes a communications interface 120, a system controller 122, a print controller 124, a treatment liquid deposition control unit 126, a first intermediate conveyance control unit 128, a head driver 130, a second intermediate conveyance control unit 132, a drying control unit 134, a third intermediate conveyance control unit 136, a fixing control unit (exposure curing control unit) 138, an in-line sensor 90, an encoder 91, a motor driver 142, a memory 144, a heater driver 146, an image buffer memory 148, a suction control unit 149, an air blowing control unit 162, and the like.

The communications interface 120 is an interface unit for receiving image data which is transmitted by a host computer 150. For the communications interface 120, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications. Image data sent from the host computer 150 is read into the inkjet recording apparatus 1 via the communications interface 120, and is stored temporarily in the memory 144.

The system controller 122 includes a central processing device (CPU) and a peripheral circuit thereof, and the like, and functions as a controller which controls the whole of the inkjet recording apparatus 1 in accordance with a prescribed program, as well as functioning as a calculation apparatus which performs various calculations. In other words, the system controller 122 controls the respective units, such as the communications interface 120, the treatment liquid deposition control unit 126, the first intermediate conveyance unit 128, the head driver 130, the second intermediate conveyance control unit 132, the drying control unit 134, the third intermediate conveyance control unit 136, the fixing control unit 138, the memory 144, the motor driver 142, the heater driver 146, the suction control unit 149, the air blowing control unit 162, and the like, as well as controlling communications with the host computer 150, controlling reading from and writing to the memory 144, and also generating control signals which control the motors 152 of the conveyance system and heaters 154.

The memory 144 is a storage device which temporarily stores an image input via the communications interface 120, and data is read from and written to this memory via the system controller 122. The memory 144 is not limited to a memory such as a semiconductor element, and may also employ a magnetic medium, such as a hard disk.

Programs to be executed by the CPU of the system controller 122 and various data required for control purposes are stored in the ROM 145. The ROM 145 may be a non-rewriteable storage device, or may be a rewriteable storage device such as an EEPROM. The memory 144 is used as a temporary storage area for image data and also serves as a development area for programs and a calculation work area for the CPU.

The motor driver 142 is a driver which drives the motor 152 in accordance with instructions from the system controller 122. In FIG. 7, the motors arranged in the respective units of the apparatus are represented by the reference numeral 152. For example, the motor 152 shown in FIG. 7 includes motors which drive the rotation of the transfer drum 52 shown in FIG. 1, the treatment liquid drum 54, the image formation drum 70, the drying drum 76, the exposure curing drum 84, the transfer drum 94, and the like, a drive motor of the pump 75 for achieving negative pressure suctioning via the suction holes of the image formation drum 70, and a motor of a withdrawal mechanism of the head units of the inkjet heads 72C, 72M, 72Y and 72K, and the like.

The heater driver 146 is a driver which drives the heater 154 in accordance with instructions from the system controller 122. In FIG. 7, the plurality of heaters which are provided in the inkjet recording apparatus 1 are represented by the reference numeral 154. For example, the heaters 154 shown in FIG. 7 include a pre-heater (not illustrated) for previously heating the recording medium 22 to a suitable temperature in the paper supply unit 10.

The print controller 124 is a control unit which has signal processing functions for carrying out processing, correction, and other treatments to generate a print control signal on the basis of the image data in the memory 144, in accordance with the control of the system controller 122, and which supplies the print data (dot data) thus generated to the head driver 130. Required signal processing is carried out in the print controller 124, and the ejection volume and the ejection timing of the ink droplets in the inkjet head 100 are controlled via the head driver 130 on the basis of the image data. By this means, a desired dot size and dot arrangement are achieved.

An image buffer memory 148 is provided in the print controller 124, and data such as image data and parameters is stored temporarily in the image buffer memory 148 during processing of the image data in the print controller 124. In FIG. 7, the image buffer memory 148 is depicted as being attached to the print controller 124, but may also serve as the memory 144. Furthermore, also possible is a mode in which the print controller 124 and the system controller 122 are integrated to form a single processor.

To give a general description of the processing from image input until print output, the image data that is to be printed is input via the communications interface 120 from an external source and is stored in the memory 144. At this stage, for example, RGB image data is stored in the memory 144.

In the inkjet recording apparatus 1, an image having tones which appear continuous to the human eye is formed by altering the droplet ejection density and dot size of fine dots of ink (coloring material), and therefore it is necessary to convert the tones of the input digital image (light/dark density of the image) into a dot pattern which reproduces the tones as faithfully as possible. In order to achieve this, data of the original image (RGB) accumulated in the memory 144 is sent to the print controller 124 via the system controller 122, and is converted into dot data for each ink color by a half-toning process using a threshold value matrix, error diffusion, or the like, in the print controller 124.

In other words, the print controller 124 carries out processing for converting the input RGB image data into dot data for the four colors of K, C, M and Y. In this way, dot data generated by the print controller 124 is stored in the image buffer memory 148.

The head driver 130 outputs a drive signal for driving the actuators 116 corresponding to the respective nozzles 102 of the inkjet head 100 on the basis of the print data supplied from the print controller 124 (in other words, dot data stored in the image buffer memory 148). The head driver 130 may also include a feedback control system for maintaining uniform drive conditions of the heads.

By applying a drive signal output from the head driver 130 to the inkjet head 100 in this way, ink is ejected from the corresponding nozzles 102. An image is formed on a recording medium 22 by controlling ink ejection from the inkjet head 100 while conveying the recording medium 22 at a prescribed speed.

Furthermore, the system controller 122 controls the treatment liquid deposition control unit 126, the first intermediate conveyance control unit 128, the second intermediate conveyance control unit 132, the drying control unit 134, the third intermediate conveyance control unit 136, the fixing control unit 138, the suction control unit 149 and the air blowing control unit 162.

The treatment liquid deposition control unit 126 controls the operation of the treatment liquid application apparatus 56 of the treatment liquid deposition unit 12 in accordance with instructions from the system controller 122.

The first intermediate conveyance control unit 128 controls the operation of the intermediate conveyance body 30 of the first intermediate conveyance unit 24 in accordance with instructions from the system controller 122. More specifically, the first intermediate conveyance control unit 128 controls the driving of the rotation of the intermediate conveyance body 30 itself, and the rotation of the holding devices which are provided on the intermediate conveyance body 30, and the like. The second intermediate conveyance control unit 132 and the third intermediate conveyance control unit 136 also perform similar control to the first intermediate conveyance control unit 128.

The suction control unit 149 and the air blowing control unit 162 control the suctioning device and the air blowing device 83 which are provided inside the drying drum 76 in accordance with control implemented by the system controller 122, in order to convey the recording medium 22 on which an image has been formed in a state of tight adherence to the drying drum 76. In the suctioning device and the air blowing device 83, the suctioning start position by the suctioning device and the air blowing position by the air blowing device 83 are controlled in accordance with the rigidity of the recording medium 22. The suctioning starting positions and air blowing positions corresponding to the rigidity based on the type are previously recorded in the ROM 145, and then the control can be carried out by directly inputting the type of the recording medium used via a personal computer (not illustrated). The suctioning start position can be controlled by the suction control unit 149 by operating the pump 75 when the recording medium has passed the suctioning start position.

Furthermore, the suctioning force produced by the suctioning device and the pressing force (air flow pressure) produced by the air blowing device are controlled on the basis of the image data in the memory 144 or the print data (dot data) generated by the print controller 124. Moreover, the suctioning force and the pressing force (air flow pressure) are controlled in the width direction of the recording medium.

Ink Composition

The ink composition in the present mode includes a pigment, and can be composed by also using a dispersant, a surfactant, and other components, according to requirements.

Pigment

The ink composition in the present invention contains at least one type of pigment as a coloring material component. There are no particular restrictions on the pigment, and it is possible to select a pigment appropriately according to the object, and for example, the pigment may be an organic or inorganic pigment. It is desirable from the viewpoint of ink coloring properties that the pigment should be one which is virtually insoluble in water or has poor solubility in water.

Dispersant

The ink composition according to the present embodiment may include at least one type of dispersant. As the pigment dispersant, it is possible to use either a polymer dispersant or a low-molecular surfactant type dispersant. Furthermore, the polymer dispersant may be a water-soluble dispersant or a water-insoluble dispersant.

The weight-average molecular weight of the polymer dispersant is desirably 3,000 to 100,000, more desirably, 5,000 to 50,000, yet more desirably, 5,000 to 40,000, and especially desirably, 10,000 to 40,000.

The acid value of the polymer dispersant is desirably not more than 100 mg KOH/g, from the viewpoint of achieving good aggregating properties upon making contact with the treatment liquid. Furthermore, the acid value is more desirably 25 to 100 mg KOH/g, yet more desirably, 25 to 80 mg KOH/g, and especially desirably, 30 to 65 mg KOH/g. If the acid value of the polymer dispersant is not less than 25, then the self-dispersing properties thereof have good stability.

From the viewpoint of self-dispersing properties and the aggregation speed upon contact with the treatment liquid, the polymer dispersant desirably includes a polymer having a carboxyl group, and more desirably includes a polymer having a carboxyl group with an acid value of 25 to 80 mg KOH/g.

In the present mode, from the viewpoint of the lightfastness and the quality of the image, and the like, desirably, a pigment and a dispersant are included, more desirably, an organic pigment and a polymer dispersant are included, and especially desirably, an organic pigment and a polymer dispersant having a carboxyl group are included. Furthermore, from the viewpoint of aggregating properties, desirably, the pigment is coated with a polymer dispersant having a carboxyl group and is insoluble in water. Moreover, from the viewpoint of aggregating properties, desirably, the acid value of the self-dispersing polymer particles which are described hereinafter is smaller than the acid value of the above-described polymer dispersant.

The average particle size of the pigment is desirably 10 to 200 nm, more desirably, 10 to 150 nm, and yet more desirably, 10 to 100 nm. Good color reproduction and good droplet ejection characteristics when ejecting by an inkjet method are obtained if the average particle size is not greater than 200 nm, and good lightfastness is obtained if the average particle size is not less than 10 nm. Furthermore, there are no particular restrictions on the particle size distribution of the coloring material, and it is possible to have a broad particle size distribution or a mono-disperse particle size distribution. Furthermore, it is also possible to combine and use two or more types of coloring material having a mono-disperse particle size distribution.

The average particle size and the particle size distribution of the pigment particles can be determined by measuring the volume-average particle size by dynamic light scattering using a UPA-EX150 Nanotrac particle size distribution analyzer (measurement device) manufactured by NIKKISO CO., LTD.

It is possible to use one type of pigment or two or more type of pigments in combination.

From the viewpoint of image density, the content of the pigment in the ink composition is desirably, 1 to 25 percent by mass, more desirably, 2 to 20 percent by mass, yet more desirably, 5 to 20 percent by mass, and especially desirably, 5 to 15 percent by mass, with respect to the ink composition.

Polymer Particles

The ink component of the present mode may include polymer particles of at least one type. The polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image.

In order to react with the aggregating agent, polymer particles having an anionic surface charge can be used, and a commonly known latex can be used, provided that adequate reactivity and ejection stability can be obtained; however, it is especially desirable to use self-dispersing polymer particles.

Self-Dispersing Polymer Particles

Desirably, the ink composition in the present mode includes at least one type of self-dispersing polymer particles as the polymer particles. The self-dispersing polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image. Furthermore, the self-dispersing polymer comprises resin particles which are desirable from the viewpoint of the ejection stability and the stability of the liquid composition containing the pigment (and in particular, dispersion stability).

Self-dispersing polymer particles means particles of a water-insoluble polymer which does not contain free emulsifier and which can be obtained as a dispersion in an aqueous medium due to a functional group (particularly, an acid group or salt thereof) contained in the polymer itself, without the presence of another surfactant.

The acid value of the self-dispersing polymer in the present mode is desirably not more than 50 KOH mg/g, from the viewpoint of achieving good aggregating properties upon making contact with the treatment liquid. Moreover, the acid value is more desirably 25 to 50 KOH mg/g, and even more desirably, 30 to 50 KOH mg/g. If the acid value of the self-dispersing polymer is not less than 25 mg KOH/g, then the self-dispersing properties thereof have good stability.

From the viewpoint of self-dispersion properties and the aggregation speed upon contact with the treatment liquid, the particles of self-dispersing polymer in the present mode desirably include a polymer having a carboxyl group, more desirably include a polymer having a carboxyl group and an acid value of 25 to 50 KOH mg/g, and even more desirably include a polymer having a carboxyl group and an acid value of 30 to 50 KOH mg/g.

As regards the molecular weight of the water-insoluble polymer which constitutes the self-dispersing polymer particles, a weight-average molecular weight of 3000 to 200,000 is desirable, 5000 to 150,000, more desirable, and 10,000 to 100,000, even more desirable. By having a weight-average molecular weight of not less than 3000, it is possible to restrict the amount of water-soluble component effectively. Furthermore, by having a weight-average molecular weight of not more than 200,000, it is possible to improve the self-dispersion stability.

The weight-average molecular weight is measured by gel permeation chromatography (GPC). The GPC is carried out using an HLC-8220 GPC device (made by TOSOH CORPORATION) and three columns, a TSK gel Super HZM-H, TSK gel Super HZ 4000 and TSK gel Super HZ2000 (made by TOSOH CORPORATION; 4.6 mm ID by 15 cm), with an eluent of THF (tetrahydrofuran). Furthermore, the chromatography conditions include: the sample density of 0.35/min, flow rate of 0.35 ml/min, sample inlet amount of 10 μl, and measurement temperature of 40° C., and an IR detector is used. Moreover, a calibration curve is created from eight samples manufactured by TOSOH CORPORATION: "standard sample TSK standard, polystyrene": "F-40", "F-20", "F-4", "F-1", "A-5000", "A-2500", "A-1000", "n-propyl benzene".

The average particle size of the self-dispersing polymer particles is desirably in the range of 10 nm to 400 nm, more desirably in the range of 10 to 200 nm, and even more desirably, in the range of 10 to 100 nm, as a volume-average particle size. If the volume-average particle size is not less than 10 nm, manufacturability is improved, and if the volume-average particle size is not more than 1 μm, then storage stability is improved.

The average particle size and the particle size distribution of the particles of self-dispersing polymer are determined by measuring the volume-average particle size by dynamic light scattering using a UPA-EX150 Nanotrac particle size distribution analyzer (measurement device) manufactured by NIKKISO CO., LTD.

The particles of self-dispersing polymer used may be of one type only or a combination of two or more types. The content of the self-dispersing polymer particles in the ink composition is desirably 1 to 30 percent by mass and more desirably 5 to 15 percent by mass with respect to the ink composition, from the viewpoint of the aggregation speed and the image luster, and so on.

Furthermore, the content ratio between the pigment and the self-dispersing polymer particles in the ink composition (for example, the ratio of water-insoluble pigment particles/self-dispersing polymer particles) is desirably 1/0.5 to 1/10 and more desirably 1/1 to 1/4, from the viewpoint of the wear resistance of the image, and the like.

Polymerizable Compound

The ink composition according to the present embodiment may include at least one type of water-soluble polymerizable compound which is polymerized by an active energy beam.

Water-soluble means that the compound can be dissolved to a prescribed density or above in water, and the compound should be dissolvable in an aqueous ink (and desirably in a uniform fashion). Furthermore, the compound may also be dissolved in the ink (desirably in a uniform fashion), by raising the solubility through the addition of a water-soluble organic solvent which is described hereinafter. More specifically, the solubility of the compound with respect to water is desirably not less than 10 percent by mass and more desirably, not less than 15 percent by mass.

From the viewpoint of avoiding obstacles to the reaction between the aggregating agent, the pigment and the polymer particles, the polymerizable compound is desirably a non-ionic or cationic polymerizable compound and desirably is a polymerizable compound having a solubility with respect to water of not less than 10 percent by mass (and more desirably, not less than 15 percent by mass).

From the viewpoint of raising resistance to wear, the polymerizable compound of the present mode is desirably a polyfunctional monomer, desirably a bifunctional to a hexafunctional monomer, and from the viewpoint of achieving both solubility and wear resistance, a bifunctional to a tetrafunctional monomer.

It is possible to include only one type or a combination of two or more types of polymerizable compound.

The content of the polymerizable compound in the ink composition is desirably 30 to 300 percent by mass and more desirably 50 to 200 percent by mass, with respect to the total solid content of the pigment plus the self-dispersing polymer particles. If the content of the polymerizable compound is not less than 30 percent by mass, then the image strength is improved and excellent wear resistance of the image is obtained, whereas if the content is not more than 300 percent by mass, then a benefit is obtained in terms of pile height.

Initiator

The ink composition according to the present embodiment may also contain at least one type of initiator which initiates polymerization of the polymerizable compound by an active energy beam, either in addition to the treatment liquid described below or in the absence of the treatment liquid described below. A photopolymerization initiator may be used, either one type only or a combination or two or more types, and may be used conjointly with a sensitizing agent.

The initiator may include a suitably selected compound which is capable of starting a polymerization reaction by application of an active energy beam; for example, it is possible to use an initiator (for example, a photopolymerization initiator or the like) which creates an active species (radical, acid, base, or the like) upon application of a beam of radiation, light or an electron beam.

If an initiator is included, then the content of the initiator with respect to the ink composition is desirably 1 to 40 percent by mass, and more desirably, 5 to 30 percent by mass, with respect to the polymerizable compound. If the content of the initiator is not less than 1 percent by mass, then the wear resistance of the image is further improved, which is beneficial in the case of high-speed recording, and if the content of the initiator is not more than 40 percent by mass, then a benefit in terms of ejection stability is obtained.

Water-Soluble Organic Solvent

The ink composition according to the present embodiment may include at least one type of water-soluble organic solvent. A water-soluble organic solvent can bring about beneficial effects in preventing drying, moistening or promoting permeation. In order to prevent drying, the solvent is used as an anti-drying agent which prevents blockages caused by ink adhering to the ink ejection ports of the ejection nozzles and drying to form aggregate material, and in order to prevent drying and achieve moistening, a water-soluble organic solvent having a lower vapor pressure than water is desirable. Furthermore, in order to promote permeation, it can be used as a permeation promoter which raises the permeability of the ink into the paper.

A water-soluble organic solvent having a lower vapor pressure than water is desirable as an anti-drying agent.

It is possible to use only one type or a combination of two or more types of anti-drying agent. The content of the anti-drying agent is desirably in the range of 10 to 50 percent by mass in the ink composition.

A water-soluble organic solvent is suitable as a permeation promoter with the object of causing the ink composition to permeate more readily into the recording medium (printing paper, or the like). It is possible to use only one type or a combination of two or more types of permeation promoter. The content of the permeation promoter is desirably in the range of 5 to 30 percent by mass in the ink composition. Furthermore, the permeation promoter is desirably used in a weight range that does not cause image bleeding or print through.

Water

The ink composition includes water, but there are no particular restrictions on the amount of water. However, a desirable content of water is 10 to 99 percent by mass, more desirably, 30 to 80 percent by mass, and even more desirably, 50 to 70 percent by mass.

Other Additives

The ink composition of the present mode can be composed by using other additives apart from the components described above. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, an antifungal agent, a pH adjuster, a surface tension adjuster, an antifoaming agent, a viscosity adjuster, a dispersant, a dispersion stabilizer, an anti-rusting agent, a chelating agent, and the like.

Treatment Liquid

The treatment liquid includes at least an aggregating agent which aggregates the components in the ink composition described above, and may also be composed by using other components according to requirements. By using a treatment liquid in addition to an ink composition, it is possible to raise the speed of inkjet recording, and an image having excellent definition (reproducibility of fine lines and intricate detail portions) with good density and high resolution is obtained even during high-speed recording.

The aggregating agent used may be a compound capable of changing the pH of the ink composition, or a polyvalent metal salt, or a polyallyl amine. In the present mode, from the viewpoint of the aggregating properties of the ink composition, a compound capable of changing the pH of the ink composition is desirable, and a compound capable of lowering the pH of the ink composition is more desirable.

Of these, for the aggregating agent of the present mode, an acidic material having high water-solubility is desirable, and from the viewpoint of raising aggregating properties and fixing the whole ink, an organic acid is desirable, a bifunctional or higher organic acid is more desirable, and a bifunctional to trifunctional (bivalence or higher to trivalent or lower) acidic material is especially desirable. As a bifunctional or higher organic acid, an organic acid having a first pKa value of not more than 3.5 is desirable, and an organic acid having a first pKa value of not more than 3.0 is more desirable. More specifically, suitable examples of this acid are: phosphoric acid, oxalic acid, malonic acid, citric acid, and the like.

It is possible to use only one type, or to combine two or more types, of aggregating agent.

The content ratio of the aggregating agent which aggregates the ink composition in the treatment liquid is desirably, 1 to 50 percent by mass, more desirably, 3 to 45 percent by mass and even more desirably 5 to 40 percent by mass.

The treatment liquid may include other additives as further components, provided that this does not impair the beneficial effects of the present mode. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, an antifungal agent, a pH adjuster, a surface tension adjuster, an antifoaming agent, a viscosity adjuster, a dispersant, a dispersion stabilizer, an anti-rusting agent, a chelating agent, and the like.

Recording Medium

The inkjet recording method according to the present mode records an image on a recording medium.

There are no particular restrictions on the recording medium, but it is possible to use general printing papers that are used in normal offset printing, or the like, and whose main component is cellulose, such as so-called high-grade paper, coated paper, art paper, or the like. General printing papers having cellulose as a main component display relatively slow ink absorption and drying in image recording using a standard inkjet method which employs aqueous ink, movement of the coloring material is liable to occur after droplet ejection, and image quality is liable to decline. However, if the inkjet recording method according to the present mode is employed, then movement of the coloring material is suppressed and high-quality image recording having excellent color density and color hues can be achieved.

Of recording media, so-called coated paper which is used in general offset printing, and the like is desirable. Coated paper is generally high-quality paper or neutralized paper which is principally made of cellulose and which does not generally have a surface treatment, on which a coating layer has been provided on the surface thereof by applying a coating material. Coated paper is liable to produce problems of image quality, such as the image luster and wear resistance, and the like, in image formation using a standard aqueous inkjet method, but in the image recording method according to the present mode, non-uniformities in luster are suppressed and it is possible to obtain an image having good luster and wear resistance. In particular, it is desirable to use a coated paper having a base paper and a coating layer including an inorganic pigment, and it is more desirable to use a coated paper having a base paper and a coating layer including kaolin and/or calcium bicarbonate. More specifically, art paper, coated paper, lightweight coated paper and fine coated paper are more desirable.

In the present mode, the suctioning of the conveyance body and the air blowing position are controlled in accordance with the rigidity of the recording medium. The rigidity of the recording medium can be determined, for example, from the basis weight, and with a recording medium having a basis weight of not more than 127.9 gsm, it is desirable to set the suctioning starting position to the downstream side with respect to the air blowing position in terms of the direction of conveyance. Furthermore, with a recording medium having a basis weight exceeding 230 gsm, it is desirable that the suctioning start position should be to the upstream side with respect to the air blowing position in terms of the direction of conveyance, or in the same position as the air blowing position. The basis weight provides no more than an approximate measure, and the positions can also be changed appropriately in accordance with the size of the recording medium and the image formed thereon.

PRACTICAL EXAMPLES

The present mode is described in more specific terms below with reference to practical examples, but the present mode is not limited to these examples.

Experimental Example 1 of Second Mode

The state of suctioning when paper of half-Kiku size (636×469 mm) which had received inkjet printing was suctioned by pressure drum conveyance was evaluated on the basis of the following criteria. Suctioning was started in such a manner that the whole of the suctioned surface was in a suctioned state when the leading end of the paper arrived at a prescribed position on the surface of the conveyance body. Furthermore, as shown in FIG. 2, the air blowing device was disposed on the outer circumference of the suction drum.

<Evaluation Criteria>

○: The whole of the paper was suctioned uniformly.

Δ: Some of the paper suctioned in a floating state.

x: High frequency of paper suctioned in a floating state.

TABLE 2-1

| Paper type | Basis weight [gsm] | Relationship between suctioning start position and air blowing position: Upstream | Same position | Downstream |
|---|---|---|---|---|
| OK Top Coat (longitudinal grain) made by Oji paper Co., Ltd. | 73.3 | x | x | ○ |
| | 104.7 | x | Δ | ○ |
| | 127.9 | Δ | ○ | ○ |
| Ibest W (longitudinal grain) made by Oji paper Co., Ltd. | 210 | ○ | ○ | ○ |
| | 260 | ○ | ○ | Δ |
| | 310 | ○ | ○ | Δ |

○: The whole of the paper was suctioned uniformly.
Δ: Some of the paper suctioned in a floating state.
x: High frequency of paper suctioned in a floating state.

In the case of thin paper, if suctioning was performed to the upstream side with respect to the air blowing position in terms of the conveyance direction, then the paper was suctioned without the disorderly positioning or slackness of the paper being suitably corrected. Furthermore, in the case of thick paper, if suctioning was performed too far after the air blowing position, then the paper which had been adhered by the air blowing device reverted in position due to the rigidity of the paper, and therefore the trailing end of the paper could not be suctioned completely.

Experimental Example 2 of Second Mode

The same method as that of Experimental Example 1 was followed, apart from the fact that the air blowing device was disposed inside the transfer drum and the air blowing position was before the point where the paper made contact with the suction drum (see FIG. 5). The results are shown in Table 2-2. In Experimental Example 2, similar results to those of Experimental Example 1 were obtained.

TABLE 2-2

| Paper type | Basis weight [gsm] | Relationship between suctioning start position and air blowing position: Downstream |
|---|---|---|
| OK Top Coat (longitudinal grain) made by Oji paper Co., Ltd. | 73.3 | ○ |
| | 104.7 | ○ |
| | 127.9 | ○ |
| Ibest W (longitudinal grain) made by Oji paper Co., Ltd. | 210 | ○ |
| | 260 | Δ |
| | 310 | Δ |

Experimental Example 3 of Second Mode

An experiment was carried out using the same method, apart from the fact that air blowing devices were provided in two locations (on the outer circumference of the suction drum and inside the transfer drum) (see FIG. 6). The air blowing position in Experimental Example 3 is the position of the second air blowing device which is provided on the outer circumferential surface of the pressure drum. The results are shown in Table 2-3. Similarly to Experimental Examples 1 and 2, if the recording medium was thin paper and the suctioning start position was on the upstream side, then the paper was suctioned without correcting the disorderly position or slackness of the paper, whereas if the recording medium was thick paper and the suctioning position was on the downstream side, then the trailing end of the paper could not be suctioned completely.

TABLE 2-3

| Paper type | Basis weight [gsm] | Relationship between suctioning start position and air blowing position: Upstream | Same position | Downstream |
|---|---|---|---|---|
| OK Top Coat (longitudinal grain) made by Oji paper Co., Ltd. | 73.3 | x | Δ | ○ |
| | 104.7 | Δ | ○ | ○ |
| | 127.9 | ○ | ○ | ○ |
| Ibest W (longitudinal grain) made by Oji paper Co., Ltd. | 210 | ○ | ○ | ○ |
| | 260 | ○ | ○ | ○ |
| | 310 | ○ | ○ | Δ |

Experimental Example 4 of Second Mode

An experiment was carried out by using a similar method, apart from the fact that an air blowing device was provided on the outer circumference of the suction drum and an auxiliary suctioning device was provided to the upstream side of the position where the recording medium on the outer circumference of the suction drum was transferred from the transfer drum (see FIG. 11). The results are shown in Table 2-4. By providing the auxiliary suctioning device, results similar to those of Experimental Example 3 were obtained, and therefore it could be confirmed that the auxiliary suctioning device produces equivalent beneficial effects to an air blowing device provided inside the transfer drum.

TABLE 2-4

| Paper type | Basis weight [gsm] | Relationship between suctioning start position and air blowing position: Upstream | Same position | Downstream |
|---|---|---|---|---|
| Ibest W (longitudinal grain) made by Oji paper Co., Ltd. | 210 | ○ | ○ | ○ |
| | 260 | ○ | ○ | ○ |
| | 310 | ○ | ○ | Δ |

Experimental Example 5 of Second Mode

An experiment was carried out by the same method, using an apparatus provided with an auxiliary suctioning device at the same position as that of Experimental Example 4, in addition to the apparatus used in Experimental Example 3 (air blowing devices in two locations). The results are shown in Table 2-5. By causing the recording medium to approach the suction drum by means of the air blowing device and the auxiliary suction device, it is possible to convey a recording medium satisfactorily even when the recording medium has high rigidity and the suctioning position is delayed.

TABLE 2-5

| Paper type | Basis weight [gsm] | Relationship between suctioning start position and air blowing position: Upstream | Same position | Downstream |
|---|---|---|---|---|
| Ibest W (longitudinal grain) made by Oji paper Co., Ltd. | 210 | ○ | ○ | ○ |
| | 260 | ○ | ○ | ○ |
| | 310 | ○ | ○ | ○ |

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a treatment liquid deposition device which deposits onto a recording medium a treatment liquid including an aggregating agent having a function of increasing a viscosity of ink;

an ink ejection device which ejects droplets of the ink onto the recording medium;

a conveyance device including: a conveyance body having curvature by which the recording medium is carried and conveyed, a holding device which holds a conveyance direction leading end of the recording medium, a plurality of suction holes for suctioning the recording medium with negative pressure, and a suctioning device which performs suctioning via the suction holes;

a heating device which heats the conveyance body and the recording medium from an opposite side of the recording medium to the conveyance body; and a non-contact-type recording medium restricting device which is provided on an upstream side of the heating device in terms of a direction of conveyance of the recording medium so as to press in a non-contact fashion a conveyance direction trailing end of the recording medium from the opposite side to the conveyance body, the non-contact-type recording medium restricting device including an air blowing device configured to blow an air flow obliquely onto the recording medium from a side of the conveyance direction leading end of the recording medium toward a side of the conveyance direction trailing end of the recording medium.

2. The image forming apparatus as defined in claim 1, further comprising a controller which controls a pressing force produced by the non-contact-type recording medium restricting device in accordance with a type of the recording medium.

3. The image forming apparatus as defined in claim 2, wherein the controller controls the pressing force in such a manner that the pressing force produced by the non-contact-type recording medium restricting device progressively increases toward the conveyance direction trailing end of the recording medium.

4. The image forming apparatus as defined in claim 2, wherein the controller controls the pressing force in such a manner that the recording medium is pressed by the non-contact-type recording medium restricting device only during passage of the conveyance direction trailing end of the recording medium.

5. The image forming apparatus as defined in claim 1, wherein a region on which the droplets of the ink are not ejected is provided in the conveyance direction trailing end of the recording medium.

6. The image forming apparatus as defined in claim 1, wherein the aggregating agent is an organic acid.

7. An image forming method comprising:

a treatment liquid deposition step of depositing onto a recording medium a treatment liquid including an aggregating agent having a function of increasing a viscosity of ink;

an ink ejection step of ejecting droplets of the ink onto the recording medium;

a conveyance step of conveying the recording medium which is carried on a conveyance body having curvature and of which a conveyance direction leading end is held while suctioning the recording medium from the conveyance body via the plurality of suction holes;

a non-contact-type recording medium restricting step of pressing in a non-contact fashion a conveyance direction trailing end of the recording medium from an opposite side of the recording medium to the conveyance body, the non-contact-type recording medium restricting step including an air blowing step of blowing an air flow obliquely onto the recording medium from a side of the conveyance direction leading end of the recording medium toward a side of the conveyance direction trailing end of the recording medium; and a heating step of heating the conveyance body and the recording medium from the opposite side of the recording medium to the conveyance body.

8. The image forming method as defined in claim 7, further comprising a control step of controlling a pressing force produced in the non-contact-type recording medium restricting step in accordance with a type of the recording medium.

9. The image forming method as defined in claim 8, wherein in the control step, the pressing force produced in the non-contact-type recording medium restricting step is controlled in such a manner that the pressing force increases progressively toward the conveyance direction trailing end of the recording medium.

10. The image forming method as defined in claim 8, wherein in the control step, the pressing force produced in the non-contact-type recording medium restricting step is controlled in such a manner that the recording medium is pressed in the non-contact-type recording medium restricting step only during passage of the conveyance direction trailing end of the recording medium.

* * * * *